US010030621B2

(12) United States Patent
Nakai et al.

(10) Patent No.: US 10,030,621 B2
(45) Date of Patent: Jul. 24, 2018

(54) FUEL INJECTION VALVE

(71) Applicant: HITACHI AUTOMOTIVE SYSTEMS, LTD., Hitachinaka-shi, Ibaraki (JP)

(72) Inventors: Atsushi Nakai, Hitachinaka (JP); Yoshihito Yasukawa, Tokyo (JP); Masashi Sugaya, Hitachinaka (JP); Kiyotaka Ogura, Hitachinaka (JP); Takao Miyake, Hitachinaka (JP); Ryo Kusakabe, Hitachinaka (JP)

(73) Assignee: HITACHI AUTOMOTIVE SYSTEMS, LTD., Ibaraki (JP)

( * ) Notice: Subject to any disclaimer, the term of this patent is extended or adjusted under 35 U.S.C. 154(b) by 0 days.

(21) Appl. No.: 15/510,299

(22) PCT Filed: Jul. 10, 2015

(86) PCT No.: PCT/JP2015/069816
§ 371 (c)(1),
(2) Date: Mar. 10, 2017

(87) PCT Pub. No.: WO2016/042896
PCT Pub. Date: Mar. 24, 2016

(65) Prior Publication Data

US 2017/0260952 A1 Sep. 14, 2017

(30) Foreign Application Priority Data

Sep. 18, 2014 (JP) ..... 2014-189509

(51) Int. Cl.
*F02M 61/20* (2006.01)

(52) U.S. Cl.
CPC ..... *F02M 61/20* (2013.01)

(58) Field of Classification Search
CPC ..... F02M 61/20; F02M 51/06; F02M 61/10; F02M 51/00; F02M 51/0075; F02M 51/0625
See application file for complete search history.

(56) References Cited

U.S. PATENT DOCUMENTS 8,371,515 B2 * 2/2013 Abe ..... F02M 51/0653 239/533.11
9,080,539 B2 * 7/2015 Suzaka ..... F02M 51/0625
9,528,482 B2 * 12/2016 Abe ..... F02M 61/12

FOREIGN PATENT DOCUMENTS

JP 2006-097659 A 4/2006
JP 2011-137442 A 7/2011
JP 6219533 B2 * 10/2017 ..... F02M 51/06

OTHER PUBLICATIONS

International Search Report, PCT/JP2015/069816, dated Oct. 20, 2015, 1 pg.

* cited by examiner

*Primary Examiner* — Hieu T Vo
(74) *Attorney, Agent, or Firm* — Volpe and Koenig, P.C.

(57) ABSTRACT

A fuel injection valve includes: a valve member; an anchor configured to be relatively displaceable in a valve opening-and-closing direction with respect to the valve member; a fixed core; a first spring biasing the valve member in a valve closing direction; a second spring biasing the anchor in the valve opening direction from an opposite side of the fixed core; and a third spring biasing the anchor in the valve closing direction from the fixed core side and has a biasing force smaller than a biasing force of the first spring and larger than a biasing force of the second spring where engagement portions are provided in both the anchor and the valve member to be engaged with each other when the anchor is displaced in the valve opening direction with (Continued)

respect to the valve member, thereby regulating the displacement of the anchor in the valve opening direction.

7 Claims, 23 Drawing Sheets

FUEL INJECTION VALVE

TECHNICAL FIELD

The present invention relates to a fuel injection valve which is used in an internal combustion engine, and particularly to a fuel injection valve which injects fuel by opening or closing a fuel passage using a movable element that is electromagnetically driven.

BACKGROUND ART

A background art in this technical field includes JP 2011-137442 A (PTL 1). This publication describes a fuel injection valve which is provided with: a coil which generates a magnetic attraction force through energization during a valve opening operation to open an injection hole while removes the magnetic attraction force by stopping the energization during a valve closing operation to close the injection hole; a valve member which has a valve penetrating portion that penetrates through a movable core and a valve protrusion that protrudes from the valve penetrating portion in the radial direction to be capable of abutting on the movable core from a fixed core side, and controls the fuel injection by opening or closing the injection hole through reciprocating movement; and a movable stopper which includes a stopper penetrating portion that penetrates through the movable core and protrudes from an end face of the movable core on the fixed core side and causes the stopper penetrating portion to abut on the valve protrusion from the opposite side to the fixed core in a stop state of energization to the coil so as to form a gap between the valve protrusion and the movable core thus engaged (see the Abstract).

CITATION LIST

Patent Literature

PTL 1: JP 2011-137442 A

SUMMARY OF INVENTION

Technical Problem

In the fuel injection valve of PTL 1, a tip end (valve body) of the valve member (plunger rod) abuts on a valve seat during a valve closing operation, and then, the movable core (anchor) continues to move downward (in a valve closing direction) by an inertial force. Soon, the movable core is pushed back upward (in a valve opening direction) by a spring that biases the movable core in the valve opening direction from the opposite side of the fixed core. The movable core pushed back upward collides with the valve protrusion of the valve member and there is a possibility that the valve member is displaced upward. When the valve member is displaced upward, the injection hole is opened to perform fuel injection (secondary injection), and it is difficult to accurately inject the fuel amount. The upward displacement of the valve member in this case is affected by a biasing force of the spring that biases the movable core in the valve opening direction from the opposite side of the fixed core. If this biasing force of the spring is increased, the valve member is displaced upward when the movable core collides with the valve protrusion of the valve member. On the other hand, if the biasing force of the spring is decreased, a force to push the movable core being displaced downward upward is weakened, and the time required until the movable core returns to a stable position at a valve closing state increases. When energization of the coil is started for the subsequent fuel injection before the movable core returns to the stable position at the valve closing state, a position of the movable core at the time of starting the energization varies, which leads to a variance (error) of the fuel injection amount.

An object of the present invention is to provide a fuel injection valve that is capable of shortening an interval of fuel injection while preventing generation of secondary injection.

Solution to Problem

In order to achieve the above-described object, a fuel injection valve of the present invention generally attenuates kinetic energy of an anchor, which is displaced in a valve opening direction by a spring that biases the anchor in the valve opening direction from the opposite side of a fixed core, using a spring that biases the anchor in a valve closing direction from the fixed core side during a valve closing operation. The kinetic energy of the anchor is attenuated by the biasing spring that biases the anchor in the valve closing direction, and the anchor stops movement in the valve opening direction before colliding with a plunger rod. Alternatively, a momentary impact force applied to the plunger rod due to the collision of the anchor is reduced even when the anchor collides with the plunger rod. Accordingly, it is unnecessary to reduce the biasing force of the spring that biases the anchor in the valve opening direction from the opposite side of the fixed core, and it is possible to prevent the plunger rod from being displaced upward after the valve body abuts on the valve seat and the valve is closed.

To be specific, the fuel injection valve includes: a valve member which includes a valve body abutting on a valve seat at a tip end portion; an anchor which forms a movable element together with the valve member and is configured to be relatively displaceable in a valve opening-and-closing direction with respect to the valve member; a fixed core which attracts the anchor in a valve opening direction by causing a magnetic attraction force to act on the anchor; a first spring which biases the valve member in a valve closing direction; a second spring which biases the anchor in the valve opening direction from an opposite side of the fixed core; and a third spring which biases the anchor in the valve closing direction from the fixed core side and has a biasing force smaller than a biasing force of the first spring and larger than a biasing force of the second spring, in which engagement portions are provided in both the anchor and the valve member so as to be engaged with each other when the anchor is displaced in the valve opening direction with respect to the valve member, thereby regulating the displacement of the anchor in the valve opening direction.

Advantageous Effects of Invention

According to the present invention, it is possible to provide the fuel injection valve that is capable of shortening the interval of fuel injection while preventing the generation of the secondary injection.

Other objects, configurations, and effects which have not been described above become apparent from embodiments to be described hereinafter.

DESCRIPTION OF EMBODIMENTS

Hereinafter, embodiments according to the present invention will be described.

First Embodiment

Figure 1:
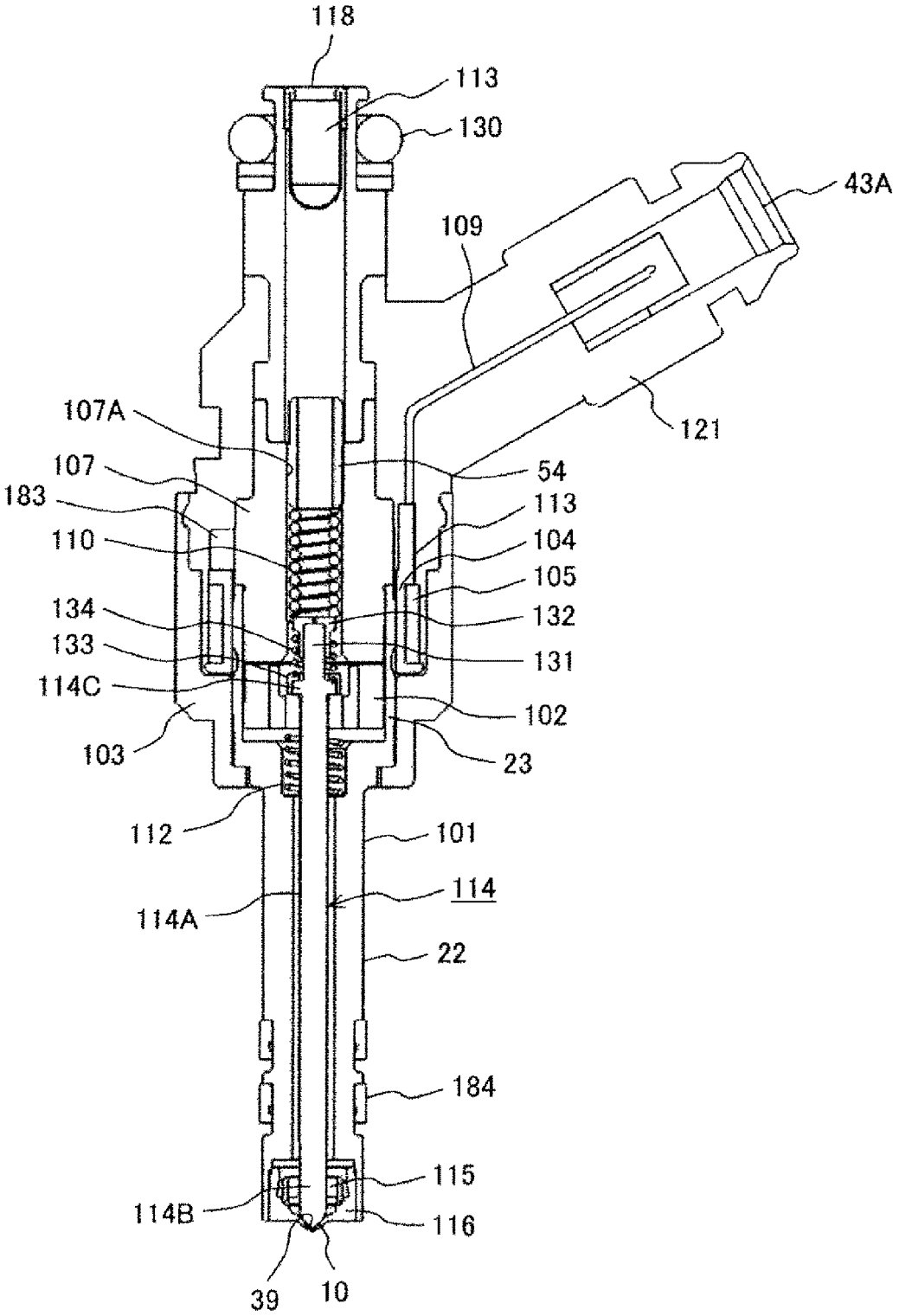
FIG. 1 is a vertical cross-sectional view illustrating a structure of a fuel injection valve according to a first embodiment of the present invention.
Figure 2:
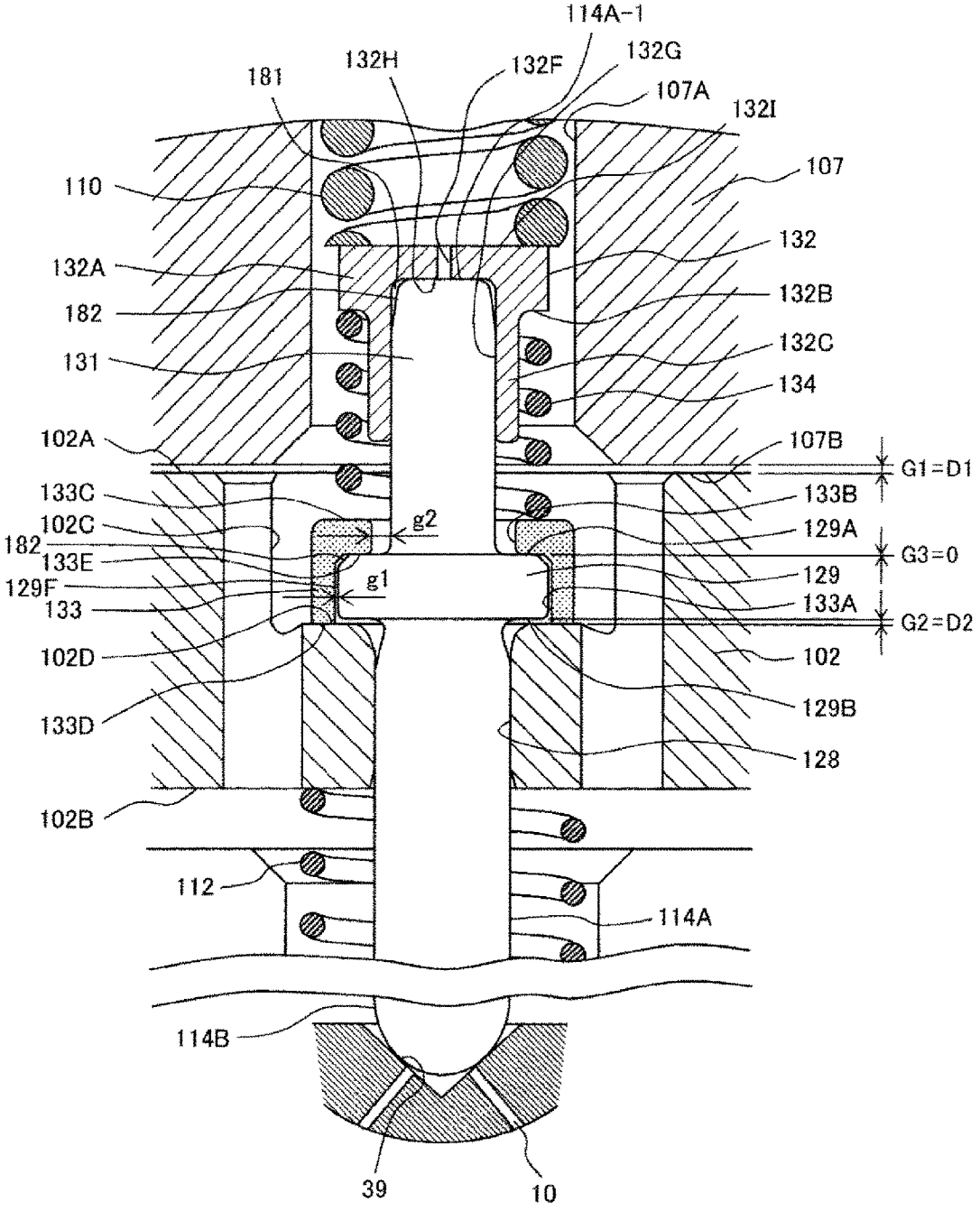
FIG. 2 is a partially enlarged view of FIG. 1 which illustrates details of the fuel injection valve according to the present embodiment.

Hereinafter, a configuration of a fuel injection valve according to a first embodiment of the present invention will be described with reference to FIGS. 1 and 2. FIG. 1 is a vertical cross-sectional view of the fuel injection valve according to the present embodiment. FIG. 2 is a partially enlarged view of FIG. 1 which illustrates details of the fuel injection valve according to the present embodiment. The fuel injection valve according to the present embodiment is an electromagnetic fuel injection valve which performs fuel injection by biasing a valve body in a valve closing direction using a spring and opening a fuel passage by electromagnetically driving a movable element. FIGS. 1 and 2 illustrate a state where energization to an electromagnetic drive unit is cut off and a valve is closed while the movable element is stopped.

In the following description, an up-and-down direction will be defined based on FIGS. 1 and 2. This up-and-down direction does not necessarily match with an up-and-down direction in a mounting state of the fuel injection valve.

A nozzle holder 101 is provided with a small-diameter tubular portion 22 having a small diameter and a large-diameter tubular portion 23 having a large diameter. A guide member 115 and an orifice cup 116 including a fuel injection port 10 are provided in the state of being inserted inside a tip end portion of the small-diameter tubular portion 22. The guide member 115 is provided at the inner side of the orifice cup 116 and is fixed to the orifice cup 116 by press-fitting or plastic bonding. The orifice cup 116 is fixed to a tip end portion of the small-diameter tubular portion 22 by welding along an outer circumferential portion of a tip end face. The guide member 115 guides an outer circumference of a valve body 114B provided at a tip end of a plunger rod (valve member) 114A forming a movable element 114 to be described later. A conical valve seat 39 is formed in the orifice cup 116 on a side facing the guide member 115. The valve body 114B provided in the tip end portion of the plunger 114A abuts on the valve seat 39 to guide or block the flow of fuel to the fuel injection port 10. A groove is formed at an outer circumference of the nozzle holder 101, and a seal member represented by a tip seal 184 made of resin is fitted into this groove.

Here, a configuration of the movable element 114 will be described in detail with reference to FIG. 2.

A head portion 114C, which includes a stepped portion 129 having an outer diameter larger than a diameter of the plunger rod 114A, is provided in an end portion of the plunger rod 114A on the opposite side to an end portion in which the valve body 114B is provided. The stepped portion (flange portion) 129 forms a flange portion projecting in a flange shape from an outer circumferential face of the plunger rod 114A. A protruding portion 131 having a smaller diameter than the stepped portion 129 is provided above an upper end face of the stepped portion 129, and a cap 132 in which a seating face of a spring (first spring) 110 is formed is provided in an upper end portion of the protruding portion 131. The cap 132 is fixed to the protruding portion 131 by press-fitting.

The movable element 114 includes an anchor 102 in which a through-hole 128 through which the plunger rod 114A penetrates is provided at the center. A zero spring (second spring) 112 is held between the anchor 102 and the nozzle holder 101. The zero spring 112 biases the anchor 102 in a valve opening direction in a state where one end portion thereof is supported by the fuel injection valve on a body side (the nozzle holder 101 in the present embodiment) and the other end portion thereof abuts on a lower end face 102B of the anchor 102. This biasing force (set load) acts on the anchor 102 in the reverse direction to a biasing force (set load) generated by the first spring 110. That is, the first spring 110 biases the plunger rod 114A in a valve closing direction, and the second spring 112 biases the anchor 102 in valve opening direction from the opposite side to the fixed core 107. Incidentally, one end portion of the first spring 110 is supported by the fuel injection valve on the body side (an adjuster 54 in the present embodiment).

A concave portion 102C is formed on an upper end face 102A of the anchor 102 toward the lower end face 102B side. An intermediate member 133 is provided at the inner side of the concave portion 102C. A concave portion 133A is formed upward on a lower face side of the intermediate member 133, and the concave portion 133A has a diameter (inner diameter) and a depth such that the stepped portion 129 of the head portion 114C is fit thereto. That is, the diameter (inner diameter) of the concave portion 133A is larger than the diameter (outer diameter) of the stepped portion 129, and the depth dimension of the concave portion 133A is larger than a dimension between an upper end face 129A and the lower end face 129B of the stepped portion 129. A through-hole 133B through which the protruding portion 131 of the head portion 114C penetrates is formed in a bottom of the concave portion 133A.

As illustrated in FIG. 2, a gap g2 is formed between the through-hole 133B and an outer circumferential face of the protruding portion 131 so that the fuel in the concave portion 133A of the intermediate member 133 easily flows out through the through-hole 133B and the fuel at the outer side of the intermediate member 133 easily flows in the concave portion 133A through the through-hole 133B. In the present embodiment, the gap g2 is set to be larger than a gap g1 between an outer circumferential face 129F of the stepped portion 129 and an inner circumferential face of the concave portion 133A of the intermediate member 133 so that the fuel favorably flows in and out of the concave portion 133A. Accordingly, the fuel causes fluid resistance, and prevents smooth displacement of the intermediate member 133 from being hindered.

In addition, it is possible to reduce a contact area between the stepped portion 129 and the intermediate member 133 and to reduce a squeezing force acting between the stepped portion 129 and the intermediate member 133 by providing a tapered portion 182 at a connection portion between the outer circumferential face 129F and the upper end face 129A of the stepped portion 129 in addition to the gap g2. Accordingly, it is possible to smoothly perform an operation of separating the intermediate member 133 from the stepped portion 129.

A tapered portion is also provided on an inner face of the intermediate member 133 in a part opposing the tapered portion 182 of the stepped portion 129, and this tapered portion and the tapered portion 182 of the stepped portion 129 are formed so as not to interfere with each other.

A spring (third spring) 134 is held between the intermediate member 133 and the cap 132, and an upper end face 133C of the intermediate member 133 forms a spring seat on which one end portion of the third spring 134 abuts. The third spring 134 biases the anchor 102 in the valve closing direction from the fixed core 107 side.

A flange portion 132A projecting in the radial direction is formed in an upper end portion of the cap 132 that is positioned above the intermediate member 133, a spring seat on which the other end portion of the third spring 134 abuts is formed on the lower end face 132B of the flange portion 132A, and a spring seat on which one end portion (lower end portion) of the first spring 110 abuts is formed on an upper end face 1321 of the flange portion 132A. A tubular portion 132C is formed downward from the lower end face of the flange portion 132A of the cap 132, and the protruding portion 131 is fixed to the tubular portion 132C by press-fitting.

Since the cap 132 and the intermediate member 133 respectively form the spring seats of the third spring 134, a diameter (inner diameter) the through-hole 133B of the intermediate member 133 is smaller than a diameter (outer diameter) of the flange portion 132A of the cap 132. Therefore, the intermediate member 133 and the third spring 134 are assembled with the plunger rod 114A prior to the press-fitting process between the cap 132 and the protruding portion 131.

The cap 132 receives the biasing force of the first spring 110 from above and receives a biasing force (set load) of the third spring 134 from below. As will be described later, the biasing force of the first spring 110 is larger than the biasing force of the third spring 134, and the cap 132 is eventually pushed to the protruding portion 131 by a biasing force corresponding to a difference between the biasing force of the first spring 110 and the biasing force of the third spring 134. A force is not applied in a direction of causing the cap 132 to exit from the protruding portion 131, and thus, it is enough to fix the cap 132 to the protruding portion 131 by press-fitting, and it is unnecessary to perform welding.

A through-hole 132F that penetrates through the flange portion 132A in the up-and-down direction is formed in the cap 132. The through-hole 132F serves as an air vent hole at the time of press-fitting the cap 132 to the plunger rod 114A (the protruding portion 131), and makes the press-fitting work of the cap 132 easy. In the present embodiment, a bottom face 132H of a concave portion 132G formed by the tubular portion 132C of the cap 132 abuts on an end portion 114A-1 of the plunger rod 114A (the protruding portion 131).

The tapered portion 182 is formed at a circumferential edge of the end portion 114A-1 of the plunger rod 114A (the protruding portion 131), and a gap portion 181 is formed between the tapered portion 182 and an inner face of the concave portion 132G of the cap 132. The gap portion 181 collects foreign matters generated at the time of press-fitting the cap 132 to the plunger rod 114A. Since the bottom face 132H of the cap 132 abuts on the end portion 114A-1 of the plunger rod 114A, the foreign matters collected in the gap portion 181 are confined in the gap portion 181. The press-fitting work becomes easy as it is configured such that the foreign matters are collected in the gap portion 181, and the foreign matters collected in the gap portion 181 do not exit to the outside, and thus, it is possible to prevent generation of failure during operation of the fuel injection valve 1.

In addition, it is necessary to provide a gap to some extent between the lower end face 132B of the cap 132 and the upper end face 133C of the intermediate member 133 in order to arrange the third spring 134. Thus, it is easy to secure a length of the tubular portion 132C of the cap 132.

The intermediate member 133 will be described again. The state illustrated in FIG. 2 is a state where the plunger rod 114A receives the biasing force generated by the first spring and an electromagnetic force does not act on the anchor 102. In this state, the fuel injection valve is closed as the valve body 114B abuts on the valve seat 39 and the movable element 114 is stopped and turned into a stable state.

In this state, the intermediate member 133 receives the biasing force of the third spring 134 and the bottom face 133E of the concave portion 133A abuts on the upper end face 129A of the stepped portion 129 of the plunger rod 114A. That is, a size (dimension) of a gap G3 between the bottom face 133E of the concave portion 133A and the upper end face 129A of the stepped portion 129 becomes zero. The bottom face 133E of the intermediate member 133 and the upper end face 129A of the stepped portion 129 form abutment faces on which the intermediate member 133 and the stepped portion 129 of the plunger rod 114A, respectively, abut.

Meanwhile, the anchor 102 receives a biasing force of the zero spring (second spring) 112 and is biased toward the fixed core 107 side. Thus, a bottom face 102D of the anchor 102 abuts on a lower end face of (opening edge of the concave portion 133A) 133D of the intermediate member 133. The biasing force of the second spring 112 is weaker (smaller) than the biasing force of the third spring 134, and thus, it is difficult for the anchor 102 to push the intermediate member 133, which has been biased by the third spring 134, back, and the upward movement (in the valve opening direction) is stopped by the intermediate member 133 and the third spring 134. The bottom face 102D of the anchor 102 and the lower end face 133D of the intermediate member 133 form abutment faces on which the anchor 102 and the intermediate member 133, respectively, abut.

A depth dimension of the concave portion 133A of the intermediate member 133 is larger than the dimension between the upper end face 129A and the lower end face 129B of the stepped portion 129, and thus, the bottom face 102D of the anchor 102 and the lower end face 129B of the stepped portion 129 do not abut on each other, and a gap G2 between the bottom face 102D and the lower end face 129B has a size (dimension) D2 in the state illustrated in FIG. 2. This gap G2 is smaller than a size (dimension) D1 of a gap G1 between the upper end face (opposing face to the fixed core 107) 102A of the anchor 102 and the lower end face (opposing face to the anchor 102) 107B of the fixed core 107 (D2<D1). As described hereinbefore, the intermediate member 133 is a member that forms the gap G2 having the size D2 between the bottom face 102D of the anchor 102 and the lower end face 129B of the stepped portion 129 and may be referred to as a gap forming member.

The intermediate member (gap forming member) 133 forms the gap D2 between the engagement portion (the lower end face of the stepped portion) 129B of the plunger rod 114A and an engagement portion (the bottom face 102D of the concave portion) of the anchor 102 as the lower end face 133D abuts on the anchor 102 in the state of being positioned on the upper end face (reference position) 129A of the stepped portion of the plunger rod 114A. The third spring 134 biases the intermediate member (gap forming member) 133 in the valve closing direction such that the intermediate member 133 is positioned on the upper end face (reference position) 129A of the stepped portion. The intermediate member 133 is positioned on the upper end face (reference position) 129A of the stepped portion as the bottom face 133E of the concave portion abuts on the upper end face (reference position) 129A of the stepped portion.

Here, the above-described biasing forces of the three springs will be described again. A spring force (biasing force) of the first spring 110 is the largest among the first spring 110, the second spring 112, and the third spring 134, a spring force (biasing force) of the third spring 134 is second largest, and a spring force (biasing force) of the second spring 112 is the smallest.

In the movable element 114 according to the present embodiment, the diameter of the through-hole 128 formed in the anchor 102 is smaller than the diameter of the stepped portion 129 of the head portion 114C, and thus, the lower end face 129B of the stepped portion 129 of the plunger rod 114A is engaged with the bottom face 102D of the anchor 102, so that the anchor 102 and the plunger rod 114A move in conjunction with each other during the valve opening operation to cause a valve closing state to transition to a valve opening state or the valve closing operation to cause the valve opening state to transition to the valve closing state. However, when a force that causes the plunger rod 114A to move upward or a force that causes the anchor 102 to move downward acts alone, the plunger rod 114A and the anchor 102 can move in directions different from each other. The operation of the movable element 114 will be described later in detail.

In the present embodiment, the anchor 102 guides the movement in the up-and-down direction (valve opening-and-closing direction) as the outer circumferential face thereof is in contact with an inner circumferential face of the large-diameter tubular portion 23 of the nozzle holder 101. Further, the plunger rod 114A guides the movement in the up-and-down direction (valve opening-and-closing direction) as the outer circumferential face thereof is in contact with an inner circumferential face of the through-hole 128 of the anchor 102. That is, the inner circumferential face of the large-diameter tubular portion 23 of the nozzle holder 101 functions as a guide when the anchor 102 moves in the axial direction, and the inner circumferential face of the through-hole 128 of the anchor 102 functions as a guide when the plunger rod 114A moves in the axial direction. The tip end portion of the plunger rod 114A is guided by a guide hole of the guide member 115 and is guided by the guide member 115 and the large-diameter tubular portion 23 of the nozzle holder 101 and the through-hole 128 of the anchor 102 so as to reciprocate straight.

The lower end face 102B of the anchor 102 opposes a stepped face between the large-diameter tubular portion 23 and the small-diameter tubular portion 22 of the nozzle holder 101 but there is no contact between both the lower end face 102B and the stepped face as the second spring 112 is interposed therebetween.

The lower end face (collision face) 107B of the core 107, the upper end face (collision face) 102A of the anchor 102, the upper and lower end faces (abutment faces) 133D and 133E of the intermediate member 133, and the upper and lower end faces (abutment faces) 129A and 129B of the stepped portion 129 are sometimes subjected to plating as necessary to improve durability. Even when the anchor 102 is made of soft magnetic stainless steel that is relatively soft, it is possible to secure the reliable durability by employing hard chromium plating or electroless nickel plating.

Incidentally, each collision force at the abutment face between the anchor 102 and the intermediate member 133, and the abutment face between the intermediate member 133 and the stepped portion 129 is significantly smaller than a collision force at the collision face between the anchor 102 and the fixed core 107, and each necessity of plating on the abutment face between the anchor 102 and the intermediate member 133 and on the abutment face between the intermediate member 133 and the stepped portion 129 is remarkably lower than the necessity of plating on the collision face between the anchor 102 and the fixed core 107.

Incidentally, the present embodiment has been described regarding the case where the upper end face 102A of the anchor 102 and the lower end face 107B of the fixed core 107 abut on each other, but there is also a case where it is configured such that a protruding portion is provided in any one of the upper end face 102A of the anchor 102 and the lower end face 107B of the fixed core 107 or both the upper end face 102A of the anchor 102 and the lower end face 107B of the fixed core 107 so that the protruding portion and the end face or the protruding portions thereof abut on each other. In this case, the above-described gap G1 becomes a gap between an abutment portion on the anchor 102 side and an abutment portion on the fixed core 107 side.

The description will be given with reference to FIG. 1 again. The fixed core 107 is press-fitted to the inner circumferential portion of the large-diameter tubular portion 23 of the nozzle holder (housing member) 101 to be bonded thereto in a press-fitting contact position by welding. The fixed core 107 is a part that causes a magnetic attraction force to act on the anchor 102 to attract the anchor 102 in the valve opening direction. A gap, formed between the inside of the large-diameter tubular portion 23 of the nozzle holder 101 and outside air, is sealed by the weld-bonding of the fixed core 107. A through-hole 107A having a diameter that is slightly larger than the diameter of the intermediate member 133 is provided at the center of the fixed core 107 as the fuel passage. The head portion 131 of the plunger rod 114A and the cap 132 are inserted in a lower end portion of the through-hole 107A along an inner circumference thereof in a non-contact state.

A lower end of the spring 110 for setting of an initial load abuts on a spring receiving face formed on an upper end face of the cap 132 provided in the head portion 131 of the plunger rod 114A, and the other end of the spring 110 is caught by an adjuster 54 to be press-fitted inside the through-hole 107A of the fixed core 107 so that the spring 110 is fixed between the cap 132 and the adjuster 54. It is possible to adjust the initial load of the spring 110 that pushes the plunger rod 114A to the valve seat 39 by adjusting a fixing position of the adjuster 54.

For stroke adjustment of the movable element 114, the anchor 102 is set inside the large-diameter tubular portion 23 of the nozzle holder 101, an electromagnetic coil 105 wound around a bobbin 104 and a housing 103 are mounted to the large-diameter tubular portion 23 of the nozzle holder 101 along an outer circumference thereof, and the plunger rod 114A assembled with the cap 132, the intermediate member 133, and the third spring 134 is inserted into the anchor 102 via the through-hole 107A of the fixed core 107. In this state, a stroke of the movable element 114 is adjusted to an arbitrary position by determining a press-fitting position of the orifice cup 116 while pressing the plunger rod 114A in the valve closing position using a jig and detecting a stroke of the plunger rod 114 at the time of energization of the coil 105.

It is configured such that the lower end face 107B of the fixed core 107 opposes the upper end face 102A of the anchor 102 of the movable element 114 with a magnetic attraction gap G1 of about 70 to 150 microns in the state where the initial load of the spring 110 is adjusted. Incidentally, the drawings are expressed in an enlarged manner while ignoring each ratio of dimensions.

The cup-shaped housing 103 is fixed to the outer circumference of the large-diameter tubular portion 23 of the nozzle holder 101. A through-hole is provided at the center of a bottom of the housing 103, and the large-diameter tubular portion 23 of the nozzle holder 101 is inserted into the through-hole. An outer circumferential wall portion of the housing 103 forms an outer circumferential yoke portion that opposes the outer circumferential face of the large-diameter tubular portion 23 of the nozzle holder 101. The annular or tubular electromagnetic coil 105 is arranged inside a tubular space formed by the housing 103. The electromagnetic coil 105 is formed of the annular coil bobbin 104 having a groove with a U-shaped cross-section, which is opened toward the radially outer side, and a copper wire wound inside the groove. A conductor 109 having rigidity is fixed to winding-start and winding-finish ends of the coil 105, and led out from the through-hole 113 provided in the fixed core 107.

An annular (C-shaped) core member 183, which is partially notched, is fitted to the outer circumferential portion of the fixed core 107, and the through-hole 113 is configured using a notched portion of the annular member. As the core member 183 is fitted to the fixed core 107 in the present embodiment, it is unnecessary to process a portion of the core member 183 by cutting. Thus, the processing work is unnecessary and it is possible to reduce material cost. When the fixed core 107 is manufactured using a manufacturing technique such as forging, the fixed core 107 and the core member 183 may be molded in an integrated manner.

Each outer circumference of the conductor 109, the fixed core 107, and the large-diameter tube portion 23 of the nozzle holder 101 is molded by injecting insulating resin from an upper end opening portion of the housing 103 along an inner circumference, and is covered by the resin molded body 121. An annular magnetic passage is formed in the fixed core 107, the anchor 102, the large-diameter tubular portion 23 of the nozzle holder 101, and the housing (outer circumferential yoke portion) 103 to surround the electromagnetic coil 105.

The through-hole (center hole) 107A of the fixed core 107 communicates with a fuel supply port 118 provided in an upper end portion (end portion on the opposite side to the fuel injection port 10) of the fuel injection valve. A filter 113 is provided inside the fuel supply port 118. A sealing material 130, which secures a liquid-tight property against a connection portion on a fuel pipe side at the time of connecting the fuel supply port 118 to the fuel pipe, is provided in the fuel supply port 118 on the outer circumference side.

Figure 14A:
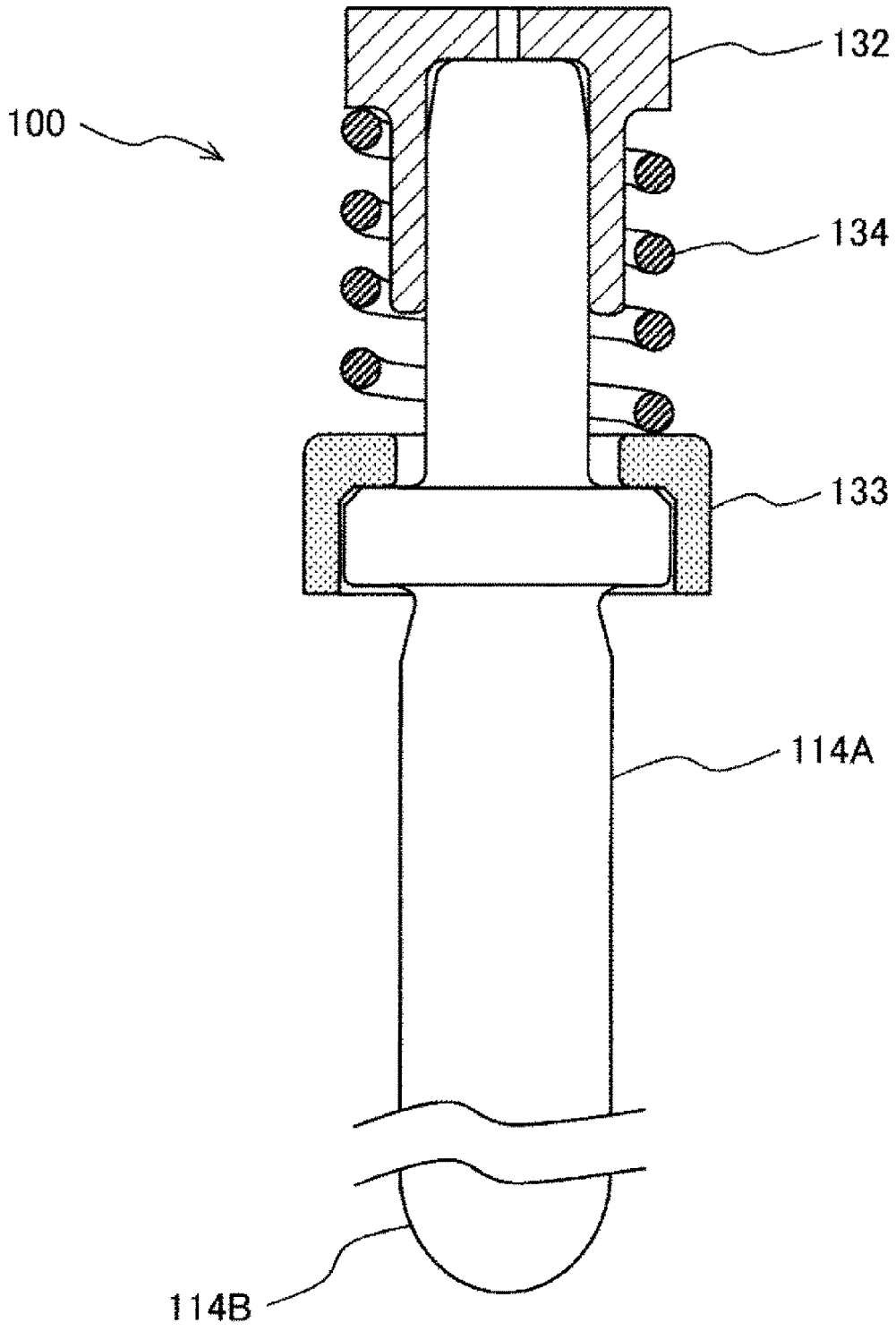
FIG. 14A is a diagram illustrating a configuration of a valve member assembly 100.
Figure 14B:
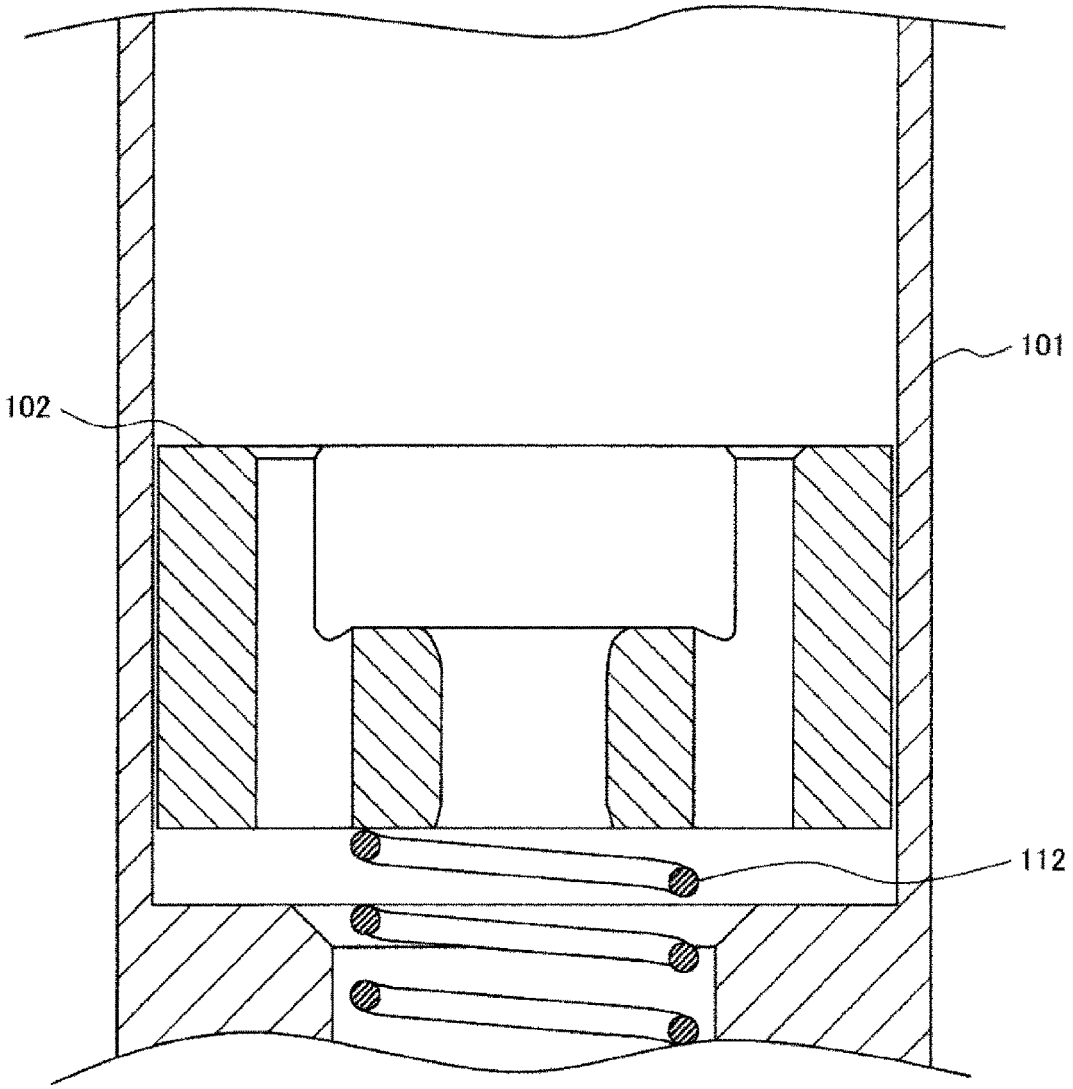
FIG. 14B is a cross-sectional view illustrating a state where the anchor 102 and the second spring 112 are assembled with a nozzle holder (housing member) 101.
Figure 14C:
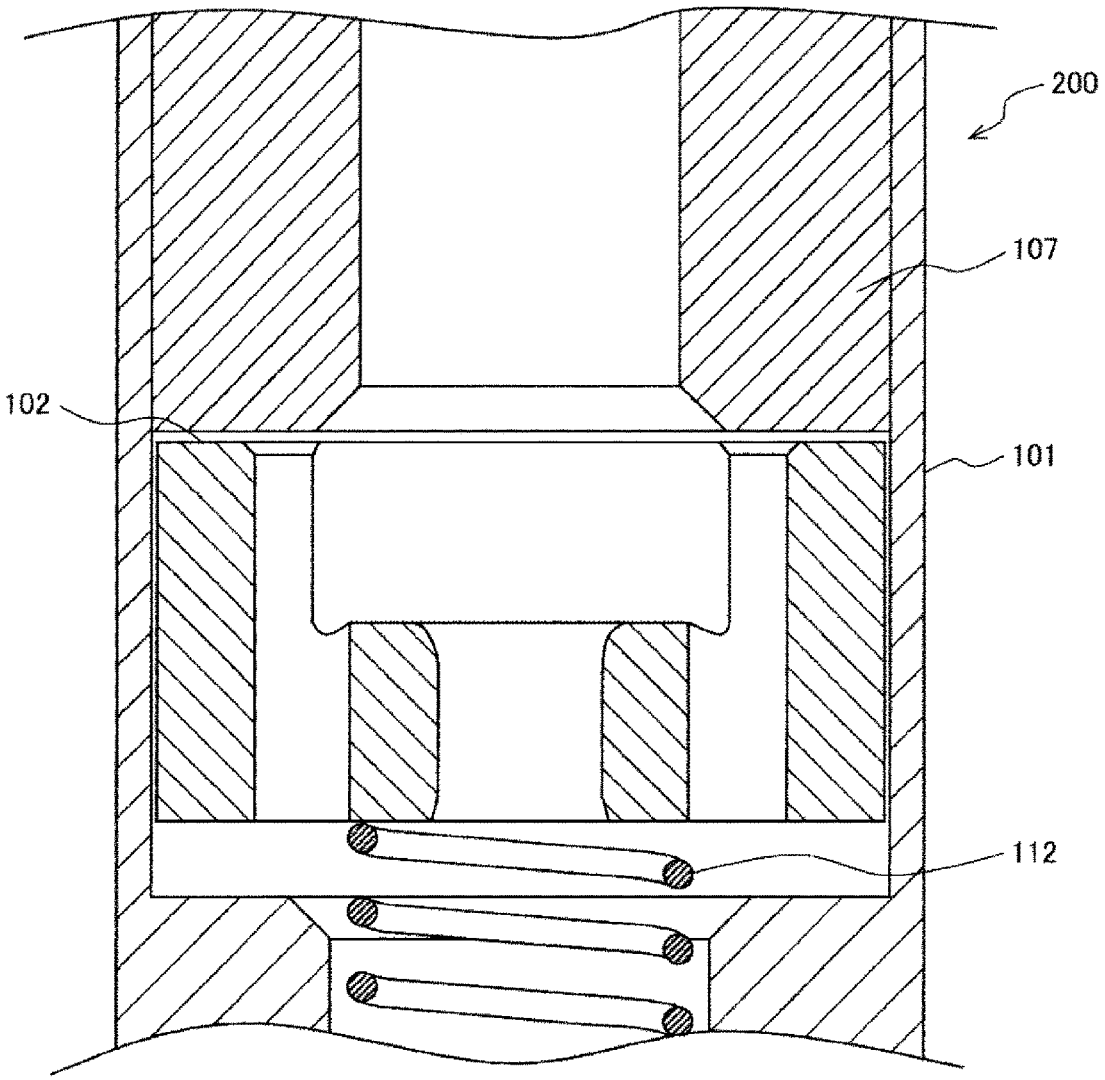
FIG. 14C is a cross-sectional view illustrating a state where a body-side assembly 200 is assembled by fixing a fixed core 107 to the nozzle holder 101 by press-fitting.
Figure 14D:
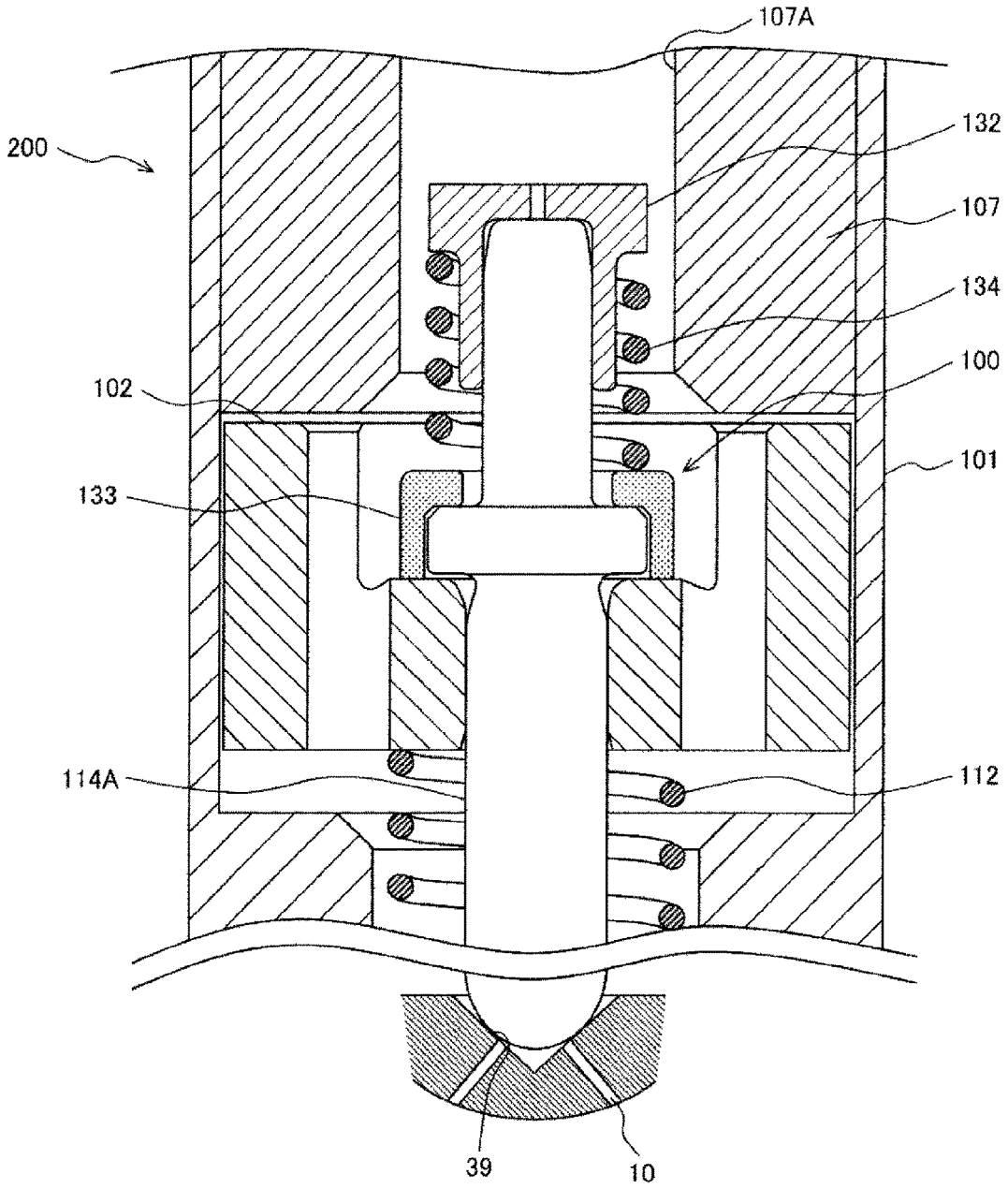
FIG. 14D is a cross-sectional view illustrating a state where the valve member assembly 100 is assembled with the body-side assembly 200.
Figure 14E:
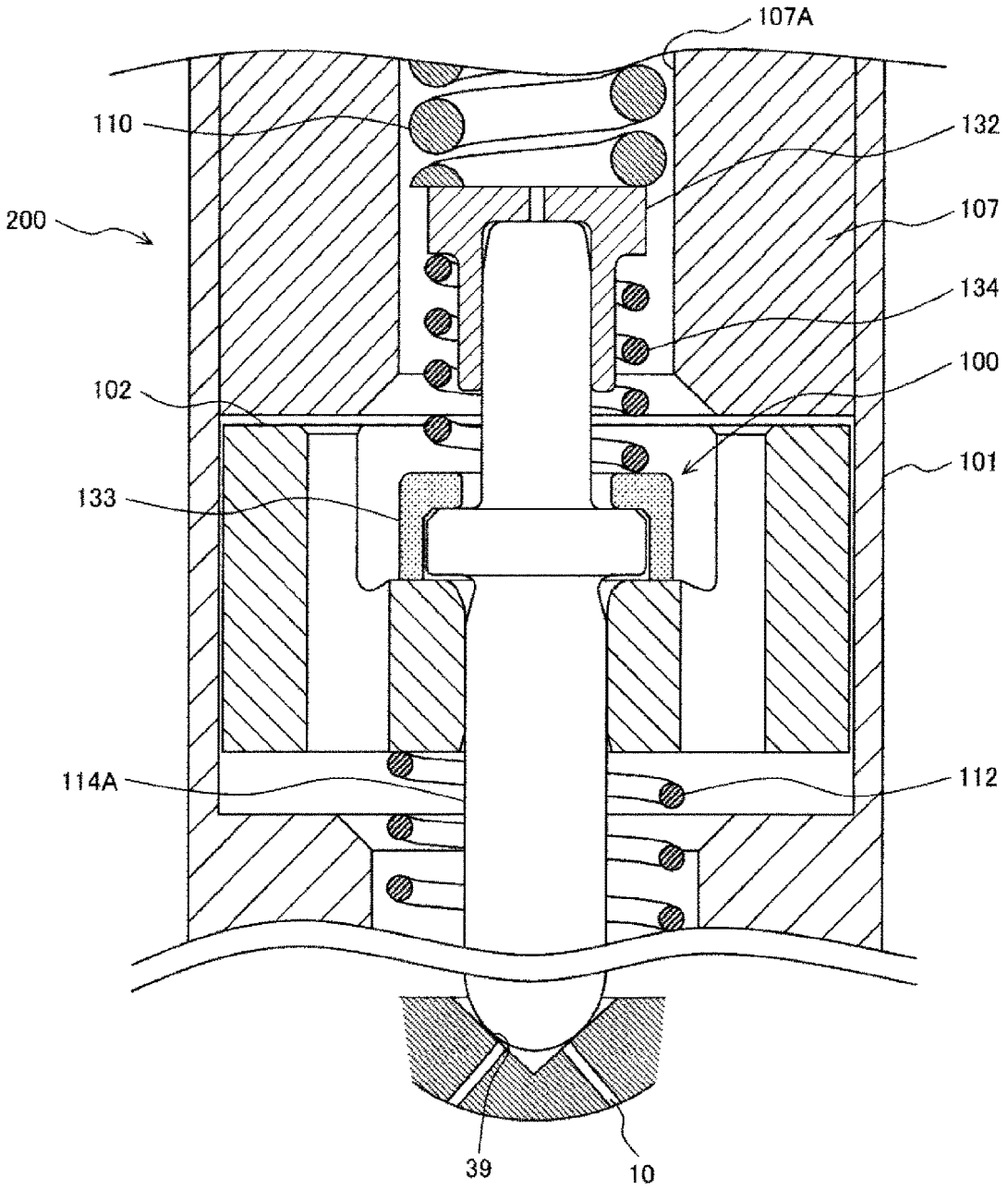
FIG. 14E is a cross-sectional view illustrating a state where the valve member assembly 100 is assembled with the body-side assembly 200 and then, a first spring 110 is assembled therewith.

Here, a method of assembling the fuel injection valve will be described with reference to FIGS. 14A to 14E. FIG. 14A is a diagram illustrating a configuration of a valve member assembly 100. FIG. 14B is a cross-sectional view illustrating a state where the anchor 102 and the second spring 112 are assembled with the nozzle holder (housing member) 101. FIG. 14C is a cross-sectional view illustrating a state where a body-side assembly 200 is assembled by fixing the fixed core 107 to the nozzle holder 101 by press-fitting. FIG. 14D is a cross-sectional view illustrating a state where the valve member assembly 100 is assembled with the body-side assembly 200. FIG. 14E is a cross-sectional view illustrating a state where the valve member assembly 100 is assembled with the body-side assembly 200 and then, the first spring 110 is assembled therewith.

The valve body 114B abutting on the valve seat 39 is provided in one end portion of the plunger rod 114A. The intermediate member (gap forming member) 133 is assembled with the plunger rod 114A from the end portion (the other end portion) on the opposite side of the end portion in which the valve body 114B is provided, and then, the third spring 134 is assembled therewith. Further, the cap (spring seat member) 132 is press-fitted to the other end portion of the plunger rod 114A, and the intermediate member 133 and the third spring 134 are held by the plunger rod 114A, thereby assembling the valve member assembly 100 (see FIG. 14A).

Separately from the assembly of the valve member assembly 100, the second spring 112 and the anchor (movable core) 102 are assembled at the inner side of the nozzle holder 101 from one end portion of the nozzle holder (housing member) 101 (see FIG. 14B), and thereafter, the fixed core 107 is fixed to the one end portion of the nozzle holder 101 by press-fitting, thereby assembling the body-side assembly 200 (see FIG. 14C). The through-hole 107A is formed in the fixed core 107 to axially penetrate through a radially central portion thereof.

Thereafter, the valve member assembly 100 is inserted into the body-side assembly 200 from the through-hole 107A of the fixed core 107 to be assembled (see FIG. 14D).

Thereafter, the first spring 110 is inserted into the through-hole 107A so that one end portion of the first spring 110 abuts on the cap 132, the adjuster 54 is mounted to the other end portion of the first spring 110 to adjust the set load of the first spring 110.

The outer diameter of the cap 132, the outer diameter of the intermediate member 133, and a maximum outer diameter of the plunger rod 114A (the outer diameter of the stepped portion 129) are smaller than the diameter (inner diameter) of the through-hole 107A such that the valve member assembly 100 is inserted inside the body-side assembly 200 from the through-hole 107A of the fixed core 107 to be assembled.

In the present embodiment, a complex mechanism formed of the intermediate member 133 and the third spring 134 can be assembled with the fuel injection valve after the assembly of the fixed core 107, and further, this mechanism can be replaced. The intermediate member 133 and the third spring 134 are assembled with the plunger rod 114A, and thus, can be easily assembled or replaced.

Next, the operation of the movable element 114 will be described with reference to FIGS. 2 to 12.

A plug to supply power from a high voltage power supply or a battery power supply is connected to a connector 43A formed in a tip end portion of the conductor 109, and energization and non-energization are controlled by a controller (not illustrated). During the energization of the coil 105, the magnetic attraction force is generated between the anchor 102 of the movable element 114 and the fixed core 107 by a magnetic flux passing through the magnetic circuit in the magnetic attraction gap G1, and the anchor 102 starts to move upward as being attracted by a force exceeding the biasing force of the third spring 134.

FIG. 2 illustrates a state (in a valve closing stop state) before the anchor 102 starts the movement in the valve opening direction. In this state, the gap G1=D1 is present between the collision face (the upper end face 102A) on the anchor 102 and the collision face (the lower end face 107B) on the fixed core 107 side, and the gap G2=D2 is present between the lower end face 129B of the stepped portion 129 of the plunger rod 114A and the bottom face 102D of the concave portion of the anchor 102. The bottom face 133E of the concave portion of the intermediate member 133 and the upper end face 129A of the stepped portion 129 are in contact with each other, and further, the lower end face 133D of the intermediate member 133 and the bottom face 102D of the concave portion of the anchor 102 are in contact with each other. The plunger rod 114A is biased in the valve closing direction by the biasing force generated by the first spring 110, and the valve body 114B abuts on the valve seat 39.

Figure 12:
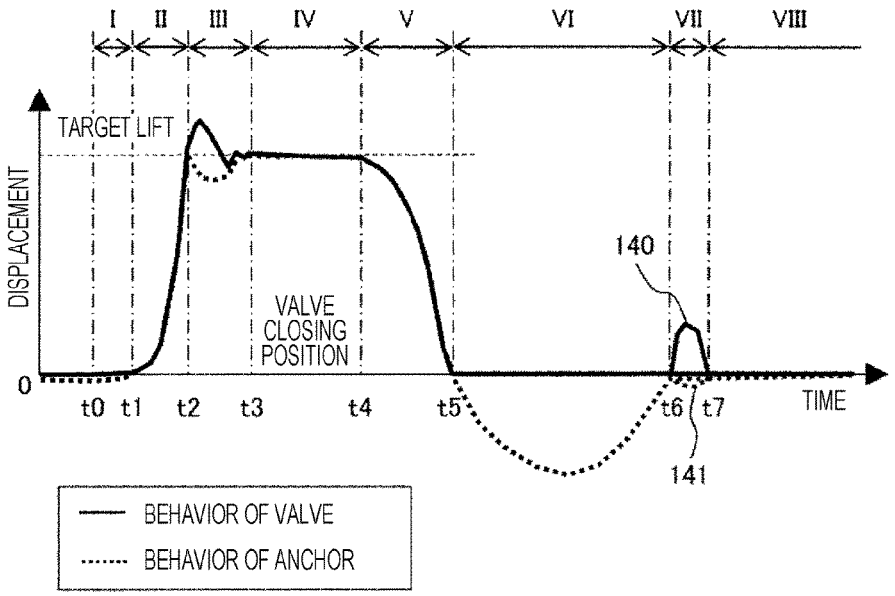
FIG. 12 is a diagram schematically illustrating a behavior of the valve body 114B and a behavior of the anchor 102.

Here, each behavior of the valve body 114B and the anchor 102 will be described with reference to FIG. 12. FIG. 12 is a diagram schematically illustrating the behavior of the valve body 114B and the behavior of the anchor 102. In FIG. 12, the horizontal axis represents time, and the vertical axis represents each displacement of the valve body 114B and the anchor 102. The solid line represents the behavior of the valve body 114B, and it is easy to understand a relative positional relationship with the anchor 102 when particularly assuming that the solid line represents a positional change of the engagement portion with the anchor 102. The dotted line represents the behavior of the anchor 102, and it is easy to understand a relative positional relationship with the plunger rod 114A when particularly assuming that the dotted line represents a positional change of the engagement portion with the plunger rod 114A that forms the valve body 114B. In addition, it is assumed that the energization of the coil 105 is started at time t0 of FIG. 12.

The state illustrated in FIG. 2 will be described. This state illustrates a state from time 0 to t0 of FIG. 12. Each of the anchor 102 and the plunger rod 114A is provided with the engagement portion such that both the anchor 102 and the plunger rod 114A are engaged with each other and displaced in the axial direction of the plunger rod 114A (the valve opening-and-closing direction) in an integrated manner. The engagement portion on the anchor 102 side is the bottom face 102D of the concave portion, and the engagement portion on the plunger rod 114A side is the lower end face 129B of the stepped portion. The bottom face 102D of the concave portion of the anchor 102 and the lower end face 129B of the stepped portion of the plunger rod 114A are engaged with each other to transmit a force acting in the axial direction to each other. That is, the anchor 102 forms the movable element 114 together with the plunger rod (valve member) 114A, and is configured to be relatively displaceable in the valve opening-and-closing direction with respect to the plunger rod 114A. In addition, the engagement portions (the bottom face 102D of the concave portion and the lower end face 129B of the stepped portion) provided in both the anchor 102 and the plunger rod 114A are engaged with each other when the anchor 102 is displaced in the valve opening direction with respect to the plunger rod 114A, thereby regulating the displacement of the anchor 102 in the valve opening direction.

In the state illustrated in FIG. 2, the engagement portion on the anchor 102 side (the bottom face 102D of the concave portion) is separated from the engagement portion on the plunger rod 114A side (the lower end face 129B of the stepped portion) and positioned below the engagement portion on the plunger rod 114A side.

Figure 3:
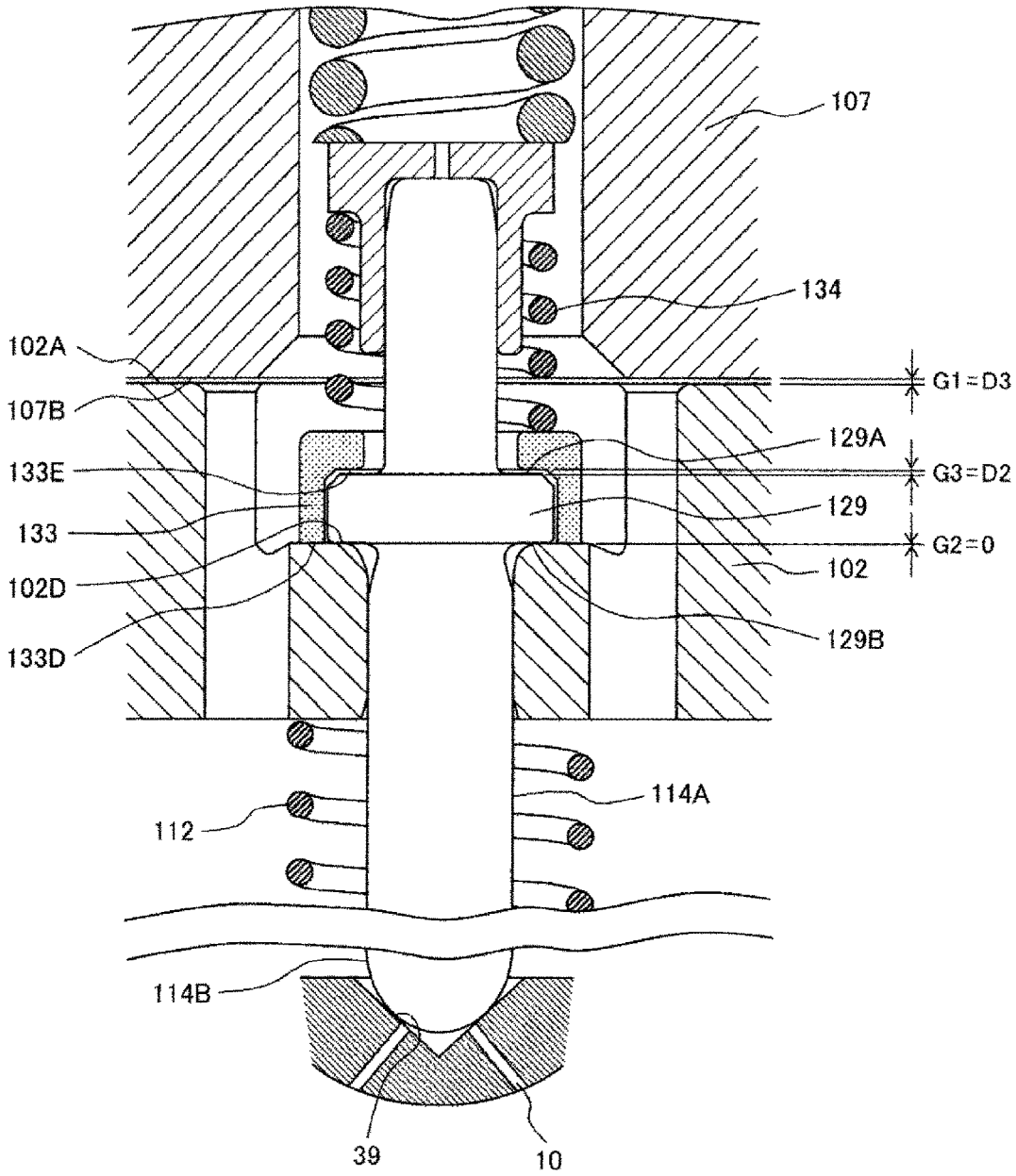
FIG. 3 is a partially enlarged view of FIG. 1 and a cross-sectional view illustrating a state of a movable element 114 in an initial stage of a valve opening operation.

FIG. 3 is a partially enlarged view of FIG. 1 and a cross-sectional view illustrating a state of the movable element 114 in an initial stage of the valve opening operation.

The state illustrated in FIG. 3 corresponds to a state at time t1 on the right end of a section I of FIG. 12. When the energization of the coil 105 is started, the magnetic attraction force acts between the anchor 102 and the fixed core 107, and the magnetic attraction force becomes larger than the biasing force of the third spring 134, the anchor 102 starts to move upward. In the section I (t0 to t1), the valve body 114B of the plunger rod 114A abuts on the valve seat 39 while the anchor 102 moves upward alone. FIG. 3 illustrates a state where the anchor 102 moves upward, and the bottom face 102D of the concave portion of the anchor 102 is engaged with the lower end face 129B of the stepped portion of the plunger rod 114A. That is, the gap G2=0.

The size of the gap G1 between the anchor 102 and the fixed core 107 is decreased to D3 by the amount of upward displacement of the anchor 102. In this case, D3 is the size that is obtained by subtracting D2 from D1 and is smaller than D1. In addition, the size (dimension) of the gap G3 between the upper end face 129A of the stepped portion of the plunger rod 114A and the bottom face 133E of the concave portion of the intermediate member 133 is D2. D2 has a dimension obtained by subtracting the dimension of the gap between the upper end face 129A and the lower end face 129B of the stepped portion 129 from the depth dimension of the concave portion 133A of the intermediate member 133. That is, D2 corresponds to the dimension which enables mutual displacement of the anchor 102 and the plunger rod 114A in a state where the lower end face 133D of the intermediate member 133 is in contact with the bottom face 102D of the concave portion of the anchor 102.

As the gap G2 has D2, the anchor 102 accelerates, and is engaged with the lower end face 129B of the stepped portion of the plunger rod 114A in the state of having a certain level of speed in the section I. Thus, it is possible to promptly lift the plunger rod 114A from a point in time of being engaged, and it is possible to promptly start the valve opening operation of the valve body 114B.

Figure 4:
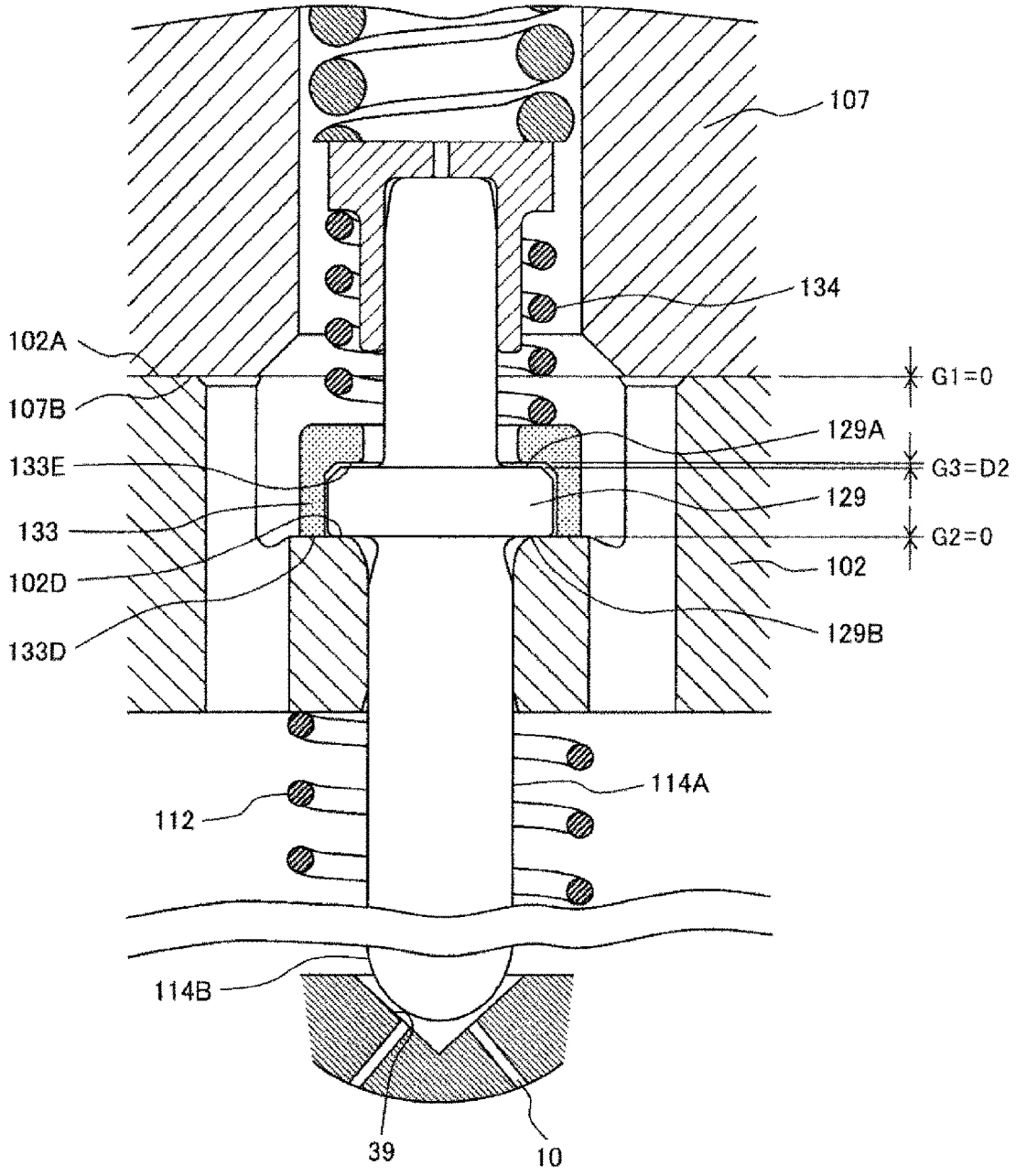
FIG. 4 is a partially enlarged view of FIG. 1 and a cross-sectional view illustrating a state of the movable element 114 where a valve body 114B is in the middle of the valve opening operation.

FIG. 4 is a partially enlarged view of FIG. 1 and a cross-sectional view illustrating a state of the movable element 114 where the valve body 114B is in the middle of the valve opening operation.

The state illustrated in FIG. 4 corresponds to a state at time t2 on the right end of a section II (t1 to t2) of FIG. 12. The anchor 102, the plunger rod 114A, and the intermediate member 133 maintain the state illustrated in FIG. 4 and move upward during the operation in the section II. The curves each of which indicates displacement of the valve body 114B and the anchor 102 overlap each other in the section II of FIG. 12, and the valve body 114B and the anchor 102 are displaced in an integrated manner. Then, the valve body 114B is separated from the valve seat 39.

FIG. 4 illustrates a moment at which the upper end face 102A of the anchor 102 collides with the lower end face 107B of the fixed core 107. In this case, the size of the gap G1 between the upper end face 102A of the anchor 102 and the lower end face 107B of the fixed core 107 is zero. In addition, the lower end face 133D of the intermediate member 133 abuts on the bottom face 102D of the concave portion of the anchor 102, and further, the lower end face 129B of the stepped portion of the plunger rod 114A and the bottom face 102D of the concave portion of the anchor 102 abut on each other (G2=0), and thus, the size of the gap G3 between the upper end face 129A of the stepped portion of the plunger rod 114A and the bottom face 133E of the concave portion of the intermediate member 133 is D2.

Figure 5:
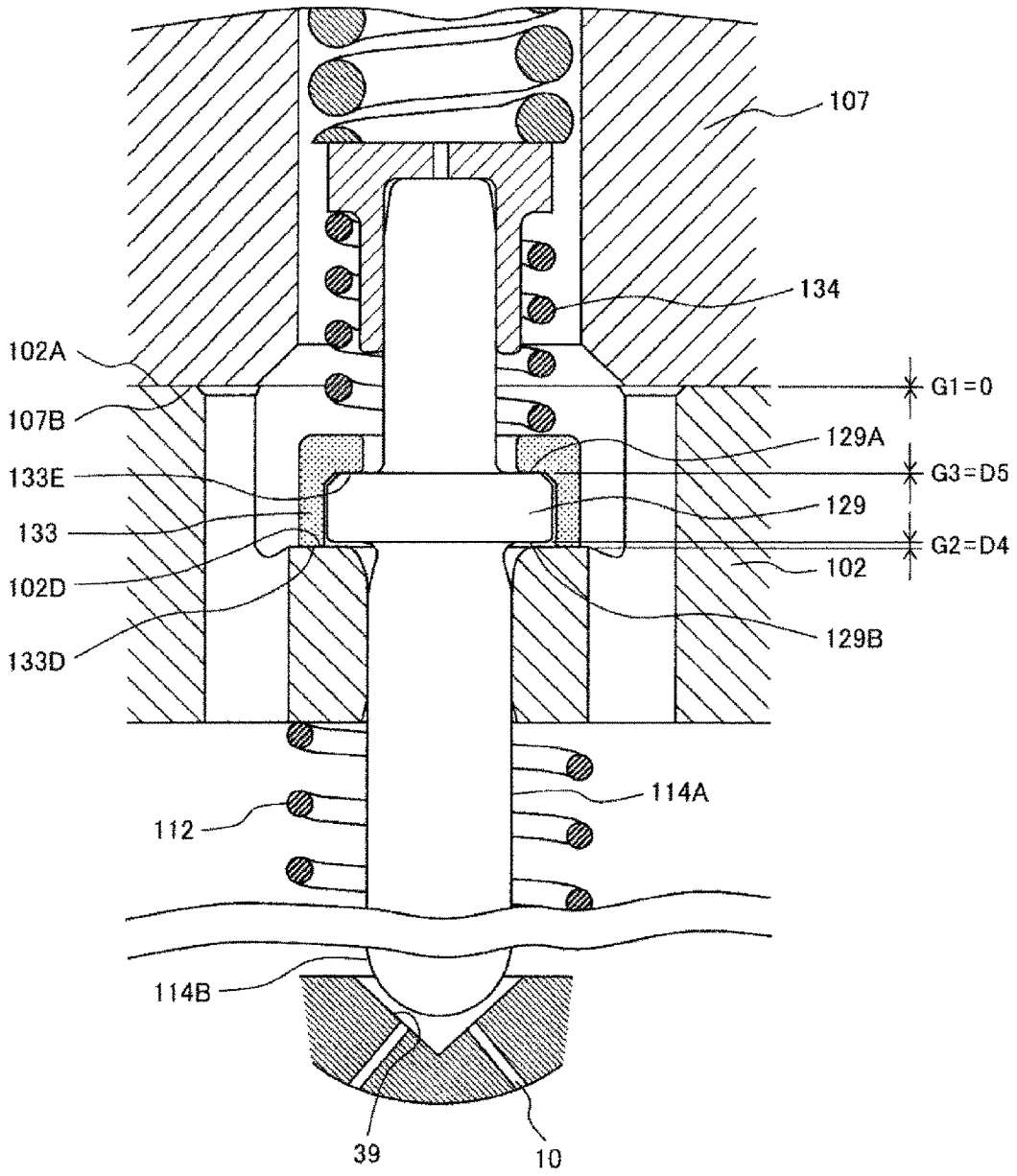
FIG. 5 is a partially enlarged view of FIG. 1 and a cross-sectional view illustrating a state where a plunger rod 114A is separated from an anchor 102 and operates alone.

FIG. 5 is a partially enlarged view of FIG. 1 and a cross-sectional view illustrating a state where the plunger rod 114A is separated from the anchor 102 and operates alone.

The state illustrated in FIG. 5 illustrates a state where the displacement of the valve body 114B becomes peak in a section III (t2 to t3) of FIG. 12. A positional relationship among the anchor 102, the plunger rod 114A, and the intermediate member 133 at this time differs depending on a bounce state of the anchor 102 from the fixed core 107, the amount of the upward movement of the plunger rod 114A, which has been made alone by the inertial force, and the like. FIG. 5 illustrates the size of the gap G1 between the upper end face 102A of the anchor 102 and the lower end face 107B of the fixed core 107 as zero. In addition, the size of the gap G2 between the lower end face 129B of the stepped portion of the plunger rod 114A and the bottom face 102D of the concave portion of the anchor 102 is illustrated as D4, and the size of the gap G3 between the upper end face 129A of the stepped portion of the plunger rod 114A and the bottom face 133E of the concave portion of the intermediate member 133 is illustrated as D5. That is, the gap G3 has a finite value of D5, and D5 is the size that is obtained by subtracting the size D4 of the gap G2 from D2.

As illustrated in FIG. 5, the upward movement of the anchor 102 is hindered when the upper end face 102A of the anchor 102 collides with the lower end face 107B of the fixed core 107. At this time, the plunger rod 114A starts to be relatively displaced with respect to the anchor 102. That is, the plunger rod 114A continues to move upward by the inertial force with respect to the anchor 102, which collides with the lower end face 107B of the fixed core 107 and stops moving upward, and accordingly the plunger rod 114A is relatively displaced with respect to the anchor 102. At this time, the engagement between the lower end face 129B of the stepped portion of the plunger rod 114A and the bottom face 102D of the concave portion of the anchor 102 is released.

When the plunger rod 114A further moves upward alone by the inertial force, G3 becomes zero so that the intermediate member 133 moves upward together with the plunger rod 114A in an integrated manner, and accordingly, there is a case where the lower end face 133D of the intermediate member 133 is separated from the bottom face 102D of the concave portion of the anchor 102. When the plunger rod 114A moves upward alone by the inertial force, the movement is performed exceeding a predetermined stroke amount, and accordingly, the gap between the valve body 114B and the valve seat 39 becomes a size exceeding a predetermined size that is maintained in a valve-opening stop state.

In addition, there is also a case where the anchor 102 bounces at the time of colliding with the fixed core 107 to bounce back below the lower end face 107B of the fixed core 107 as illustrated in FIG. 12. However, the biasing force of the first spring 110 is not transmitted to the anchor 102 since the engagement between the lower end face 129B of the stepped portion of the plunger rod 114A and the bottom face 102D of the concave portion of the anchor 102 is released. Thus, a force resisting against the magnetic attraction force disappears, and the anchor 102 receives the magnetic attraction force and is promptly pulled back to the fixed core 107. Accordingly, it is possible to suppress the bounce of the anchor 102 with respect to the fixed core 107.

Figure 6:
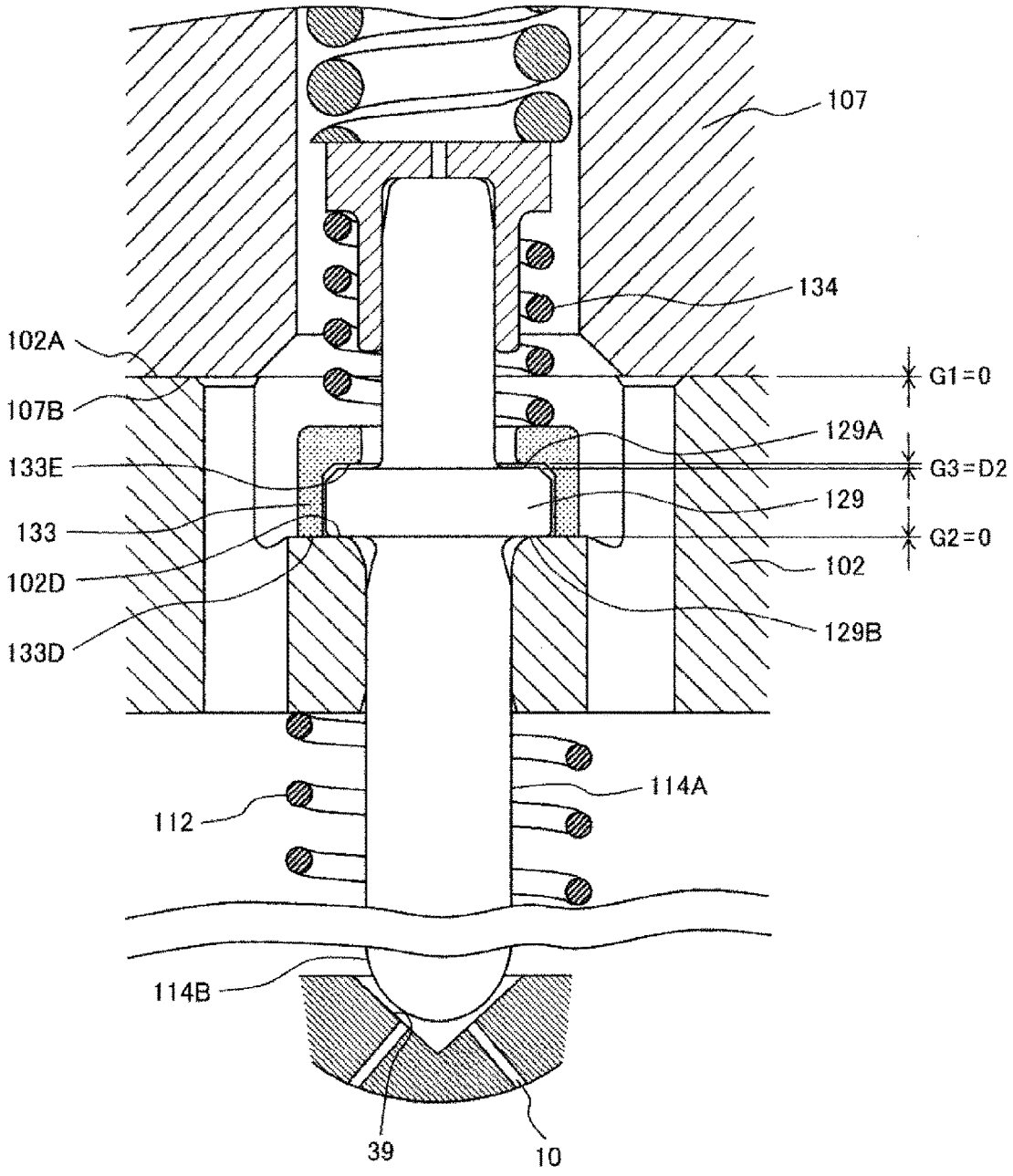
FIG. 6 is a partially enlarged view of FIG. 1 and a cross-sectional view illustrating a state where the anchor 102, the plunger rod 114A, and an intermediate member 133 are stabilized in a valve opening state.

FIG. 6 is a partially enlarged view of FIG. 1 and a cross-sectional view illustrating a state where the anchor 102, the plunger rod 114A, and the intermediate member 133 are stabilized in the valve opening state.

The state illustrated in FIG. 6 illustrates a state at time t3 on the right end of a section III (t2 to t3) of FIG. 12, and this state is maintained during a section IV (t3 to t4).

At time t3, the bounce of the anchor 102 subsides and the upper end face 102A of the anchor 102 abuts on the lower end face 107B of the fixed core 107 to be stopped. In addition, the plunger rod 114A moving upward by the inertial force is pushed back by the first spring 110, and the lower end face 129B of the stepped portion abuts on the bottom face 102D of the concave portion of the anchor 102 to be stopped. Accordingly, the valve-opening stop state is formed where the plunger rod 114A and the valve body 114B are lifted by a predetermined stroke amount.

In this state, the anchor 102 is attracted to the fixed core 107 by the magnetic attraction force, and the plunger rod 114A is biased in the valve closing direction by the biasing force of the first spring 110, and thus, the anchor 102 and the plunger rod 114A are integrated as both the engagement portions thereof are engaged with each other. That is, the lower end face 129B of the stepped portion of the plunger rod 114A and the bottom face 102D of the concave portion of the anchor 102 abut on each other, and the size of the gap G2 is zero. In addition, it is difficult for the third spring 134 to push the anchor 102 back opposing the magnetic attraction force, and thus, the lower end face 133D of the intermediate member 133 abuts on the bottom face 102D of the concave portion of the anchor 102. Thus, the size of the gap G3 between the upper end face 129A of the stepped portion of the plunger rod 114A and the bottom face 133E of the concave portion of the intermediate member 133 is D2. In addition, the anchor 102 and the fixed core 107 abut on each other as described above, and the size of the gap G1 between the upper end face 102A of the anchor 102 and the lower end face 107B of the fixed core 107 becomes zero.

Figure 7:
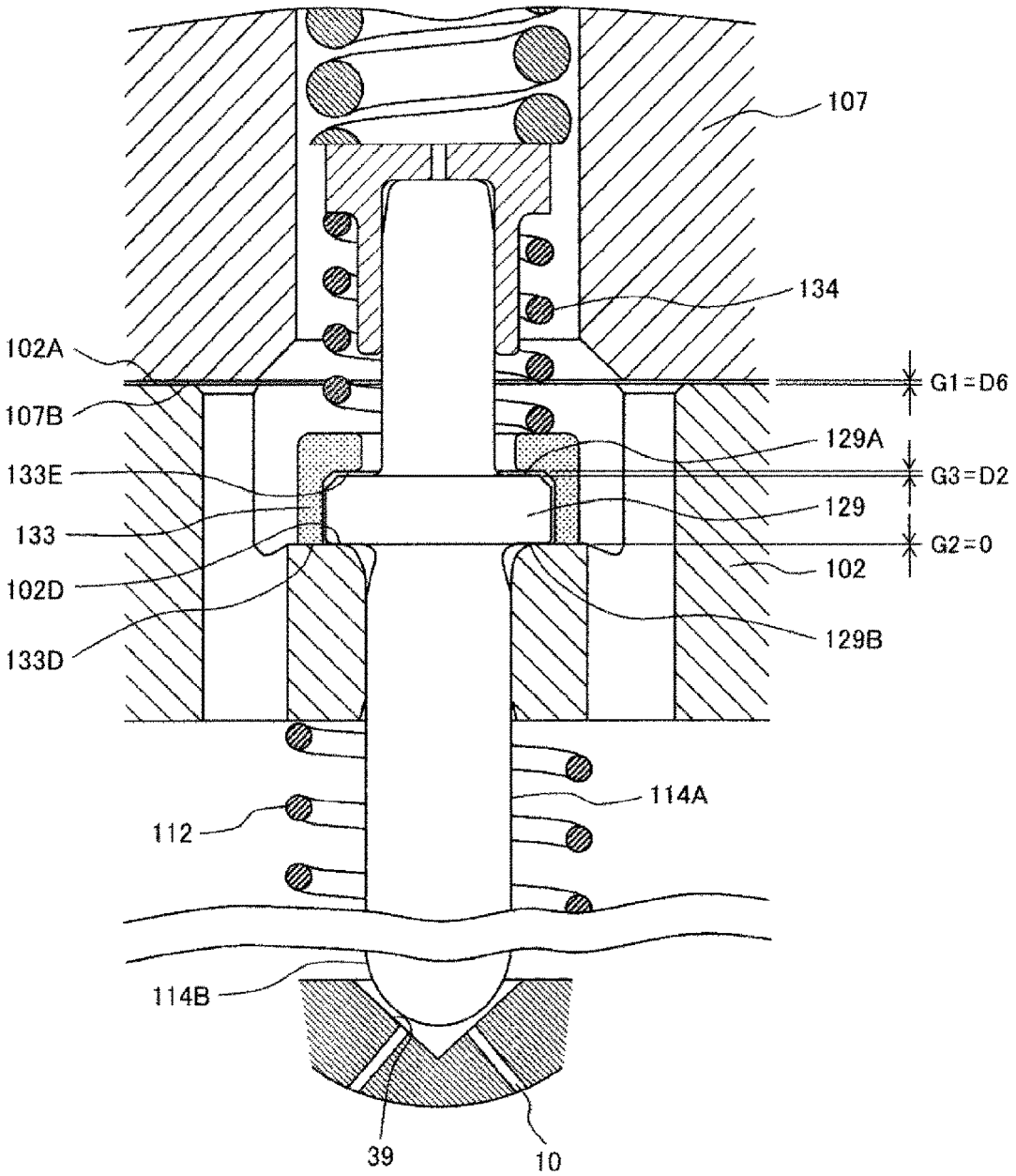
FIG. 7 is a partially enlarged view of FIG. 1 and a cross-sectional view illustrating an initial state of a valve closing operation.

FIG. 7 is a partially enlarged view of FIG. 1 and a cross-sectional view illustrating an initial state of the valve closing operation. FIG. 7 illustrates a state where the anchor 102 is pushed down by receiving the biasing force of the first spring 110 via the plunger rod 114A and is separated from the lower end face 107B of the fixed core 107 by a distance D6.

When the energization of the coil 105 is cut off and the magnetic attraction force acting between the anchor 102 and the fixed core 107 becomes smaller than the biasing force of the first spring, the movable element 114 starts to move in the valve closing direction (time t4 in FIG. 12). It takes time from the cut-off of energization of the coil 105 until the magnetic attraction force becomes lower than the biasing force of the first spring, and thus, the energization of the coil 105 is cut off prior to time t4. A section V (t4 to t5) of FIG. 12 is started from time t4 at which the anchor 102 and the plunger rod 114A start to move downward (in the valve closing direction).

Incidentally, a resultant force between the magnetic attraction force and the biasing force of the second spring acts against the biasing force of the first spring at the time of starting the valve closing, but the biasing force of the first spring is dominant during the valve closing, and thus, a description will be given by ignoring the biasing force of the second spring hereinafter.

In the state illustrated in FIG. 7, the size of the gap G1 between the upper end face 102A of the anchor 102 and the lower end face 107B of the fixed core 107 is D6 (D6<D1). In the section V, the biasing force of the first spring 110, which biases the plunger rod 114A in the valve closing direction, is dominant, thereby causing the lower end face 129B of the stepped portion of the plunger rod 114A to be engaged with the bottom face 102D of the concave portion of the anchor 102 (G2=0). In addition, the intermediate member 133 is biased by the third spring 134, and the lower end face 133D abuts on the bottom face 102D of the concave portion of the anchor 102. Thus, the size of the gap G3 between the upper end face 129A of the stepped portion of the plunger rod 114A and the bottom face 133E of the concave portion of the intermediate member 133 is D2.

The positional relationship among the anchor 102, the plunger rod 114A, and the intermediate member 133 is maintained during the section V (t4 to t5) of FIG. 12, and the anchor 102, the plunger rod 114A, and the intermediate member 133 operate in an integrated manner. The curves each of which indicates displacement of the valve body 114B and the anchor 102 overlap each other in the section V in FIG. 12 to indicate that the valve body 114B and the anchor 102 are displaced in an integrated manner. Further, the valve body 114B moves closer to the valve seat 39. At this time, the biasing force of the first spring 110 is applied to the anchor 102 via the plunger rod 114A. In addition, the third spring biases the intermediate member 133 downward, but the biasing force of the first spring 110 is dominant during the valve closing as described above, and accordingly, the operation is performed in the state where the lower end face 129B of the stepped portion of the plunger rod 114A and the bottom face 102D of the concave portion of the anchor 102 are engaged with each other by the large biasing force of the first spring.

Figure 8:
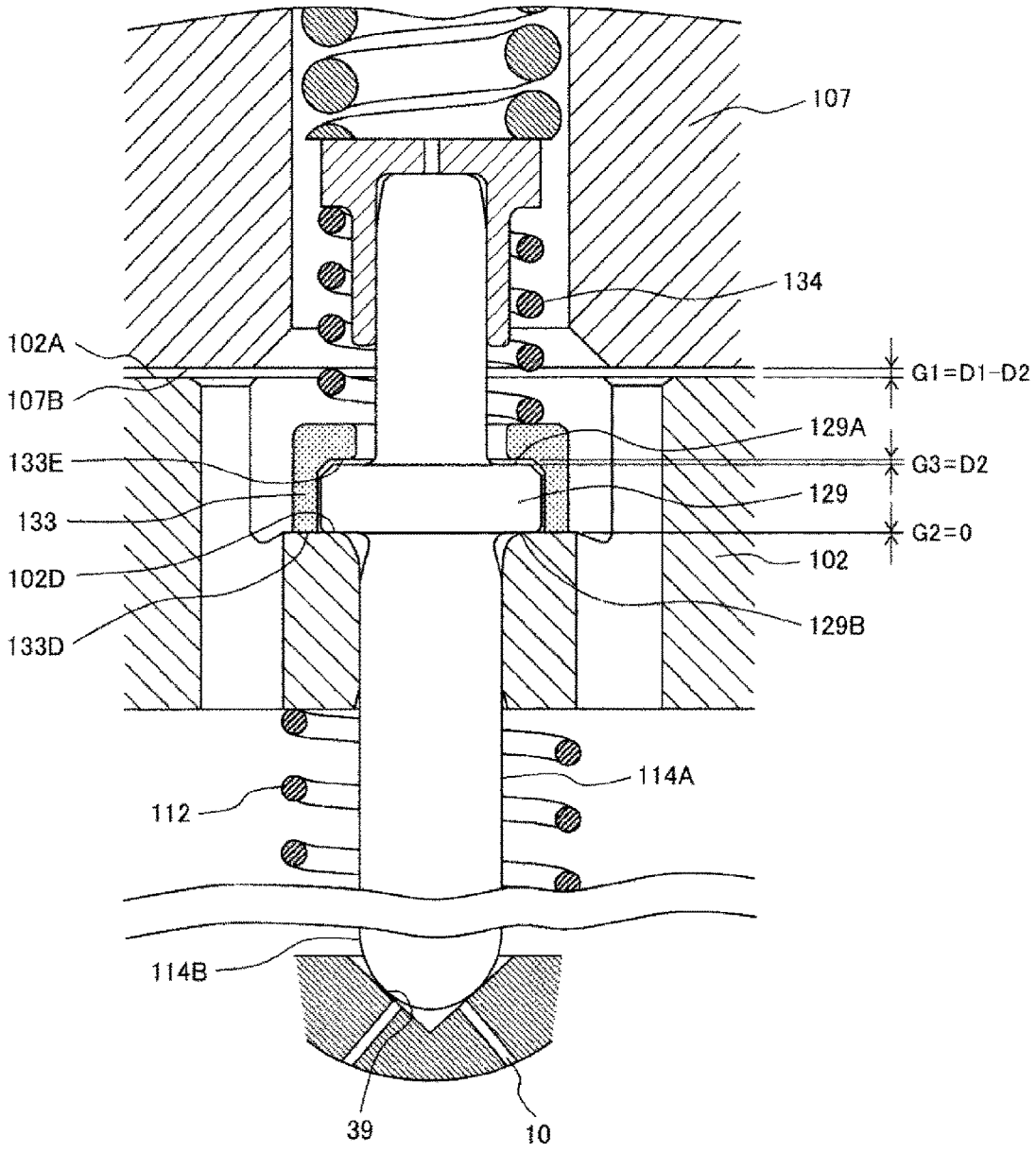
FIG. 8 is a partially enlarged view of FIG. 1 and a cross-sectional view illustrating a moment at which the valve body 114B collides with a valve seat 39 during the valve closing operation.

FIG. 8 is a partially enlarged view of FIG. 1 and a cross-sectional view illustrating a moment at which the valve body 114B collides with the valve seat 39 during the valve closing operation.

The state illustrated in FIG. 8 illustrates a state at time t5 on the right end of the section V (t4 to t5) of FIG. 12 and illustrates the moment at which the valve body 114B collides with the valve seat 39. A difference of FIG. 8 from FIG. 7 is that the size of the gap G1 between the upper end face 102A of the anchor 102 and the lower end face 107B of the fixed core 107 becomes "D1−D2", and the valve body 114B abuts on the valve seat 39. When FIG. 8 is compared with FIG. 2, G2=0, G3=D2, and the size of G1 is "D1−D2" in FIG. 8 while G2=D2, G3=0, and the size of G1 is D1 in FIG. 2.

Figure 9:
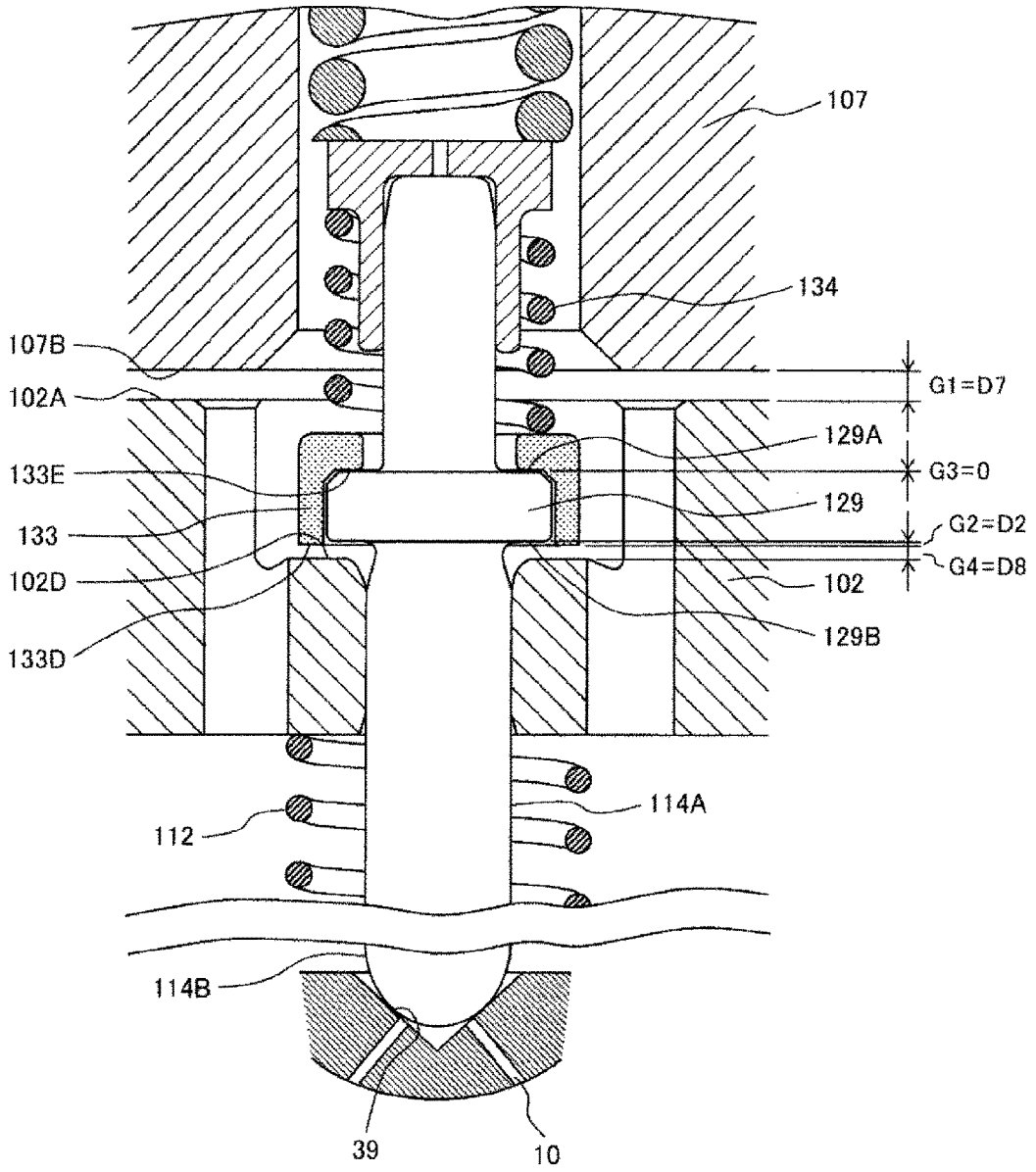
FIG. 9 is a partially enlarged view of FIG. 1 and a cross-sectional view illustrating a state where the anchor 102 is displaced alone downward after the valve body 114B collides with the valve seat 39.

FIG. 9 is a partially enlarged view of FIG. 1 and a cross-sectional view illustrating a state where the anchor 102 is displaced alone downward after the valve body 114B collides with the valve seat 39. FIG. 9 illustrates a state of the movable element 114 at time in the section VI (t5 to t6) of FIG. 12 at which the downward displacement of the anchor 102 is the largest.

When the valve body 114B collides with the valve seat 39 at time t5, the downward displacement of the valve body 114B is stopped by the valve seat 39. At this moment, the engagement between the bottom face 102D of the concave portion of the anchor 102 and the lower end face 129B of the stepped portion of the plunger rod 114A is released, and the anchor 102 continues to be displaced (moved) downward (in the valve closing direction) along by the inertial force thereof. As the engagement between the anchor 102 and the plunger rod 114A (the movable element 114) is released, the mass of the movable element 114 becomes lighter, and an impact force of the movable element 114 toward the valve seat 39 is weakened. As a result, it is possible to obtain an effect of suppressing a bouncing operation (bounce) of the plunger rod 114A with respect to the valve seat 39.

When the valve body 114B abuts on the valve seat 39, and the downward displacement of the valve body 114B is stopped, the intermediate member 133 is displaced downward by the biasing force of the third spring 134 until the bottom face 133E of the concave portion abuts on the upper end face 129A of the stepped portion 129 of the plunger rod 114A (G3=0). At this time, the lower end face 133D of the intermediate member 133 is positioned below the lower end face 129B of the stepped portion of the plunger rod 114A while being separated therefrom by the distance D2.

As the anchor 102 is displaced downward alone by the inertial force thereof, the bottom face 102D of the concave portion of the anchor 102 is separated from the lower end face 133D of the intermediate member 133. Meanwhile, a separation distance G4 between the bottom face 102D of the concave portion of the anchor 102 and the lower end face 133D of the intermediate member 133 becomes D8 at a maximum, and the size of the gap G1 between the upper end face 102A of the anchor 102 and the lower end face 107B of the fixed core 107 becomes D7 (D7>D1) at a maximum.

Thereafter, the anchor 102 is pushed back upward by the biasing force of the second spring 112.

Figure 10:
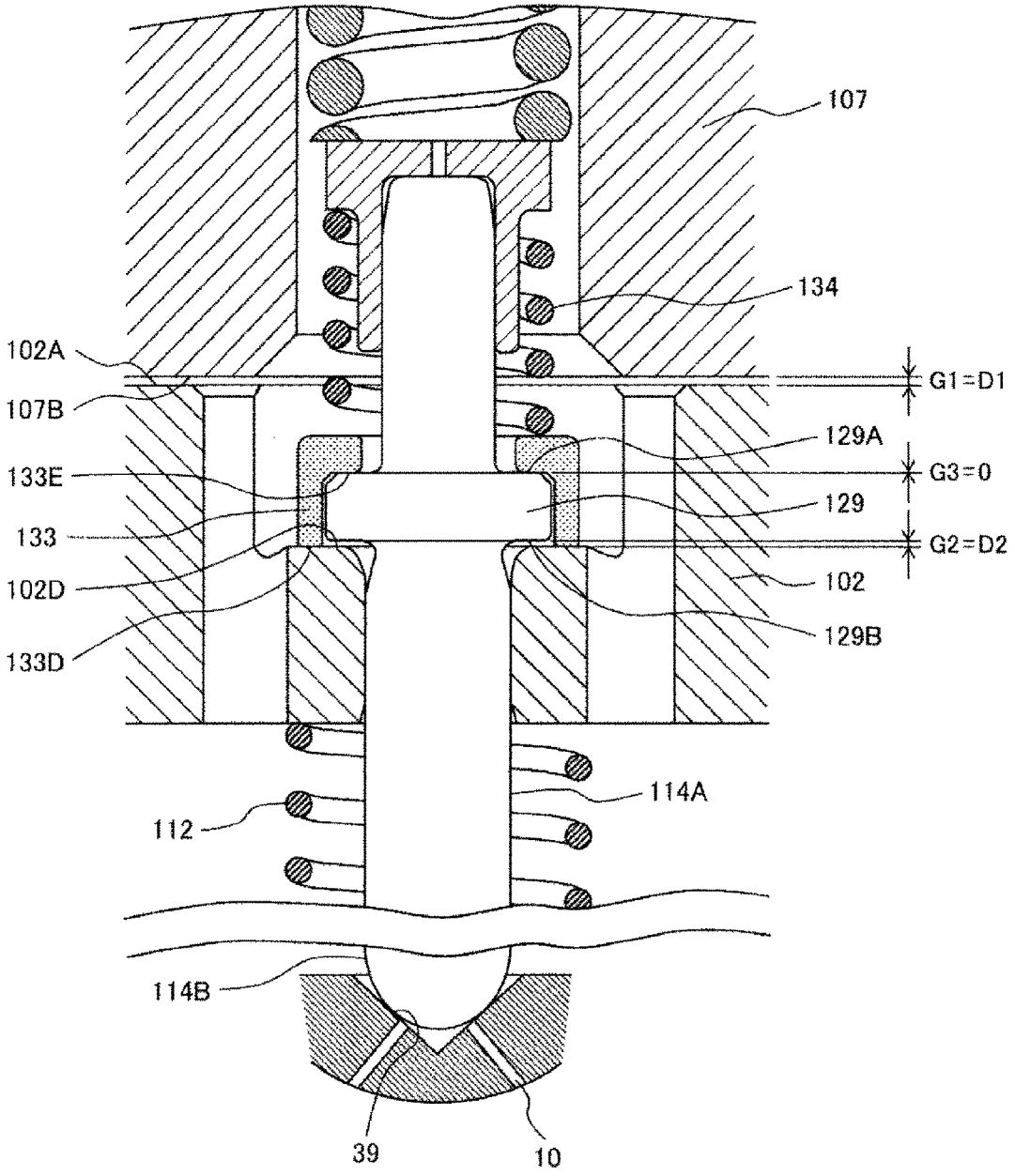
FIG. 10 is a partially enlarged view of FIG. 1 and a cross-sectional view illustrating a state where the anchor 102 is pushed back upward by a second spring 112 and collides with the intermediate member 133.

FIG. 10 is a partially enlarged view of FIG. 1 and a cross-sectional view illustrating a state where the anchor 102 is pushed back upward by the second spring 112 and collides with the intermediate member 133. The state illustrated in FIG. 10 is a state immediately prior to time t6 of a section VI (t5 to t6) of FIG. 12.

The anchor 102 pushed back by the second spring 112 first collides with the lower end face 133D of the intermediate member 133. In this stage, the anchor 102 does not collide with the lower end face 129B of the stepped portion of the plunger rod 114A since the lower end face 133D of the intermediate member 133 is positioned below the lower end face 129B of the stepped portion of the plunger rod 114A while being separated therefrom by the distance D2.

The state illustrated in FIG. 10 is the same as the state illustrated in FIG. 2 in terms that the size of the gap G1 between the upper end face 102A of the anchor 102 and the lower end face 107B of the fixed core 107 is D1, and a positional relationship among the anchor 102, the plunger rod 114A, the intermediate member 133, and the fixed core 107, but is different from the state of FIG. 2 in terms that the anchor 102 continues movement.

Incidentally, there is also a possibility that it is possible to make G4 of FIG. 9 zero depending on the biasing force of the second spring 112, the setting of D2, or the like.

Figure 11:
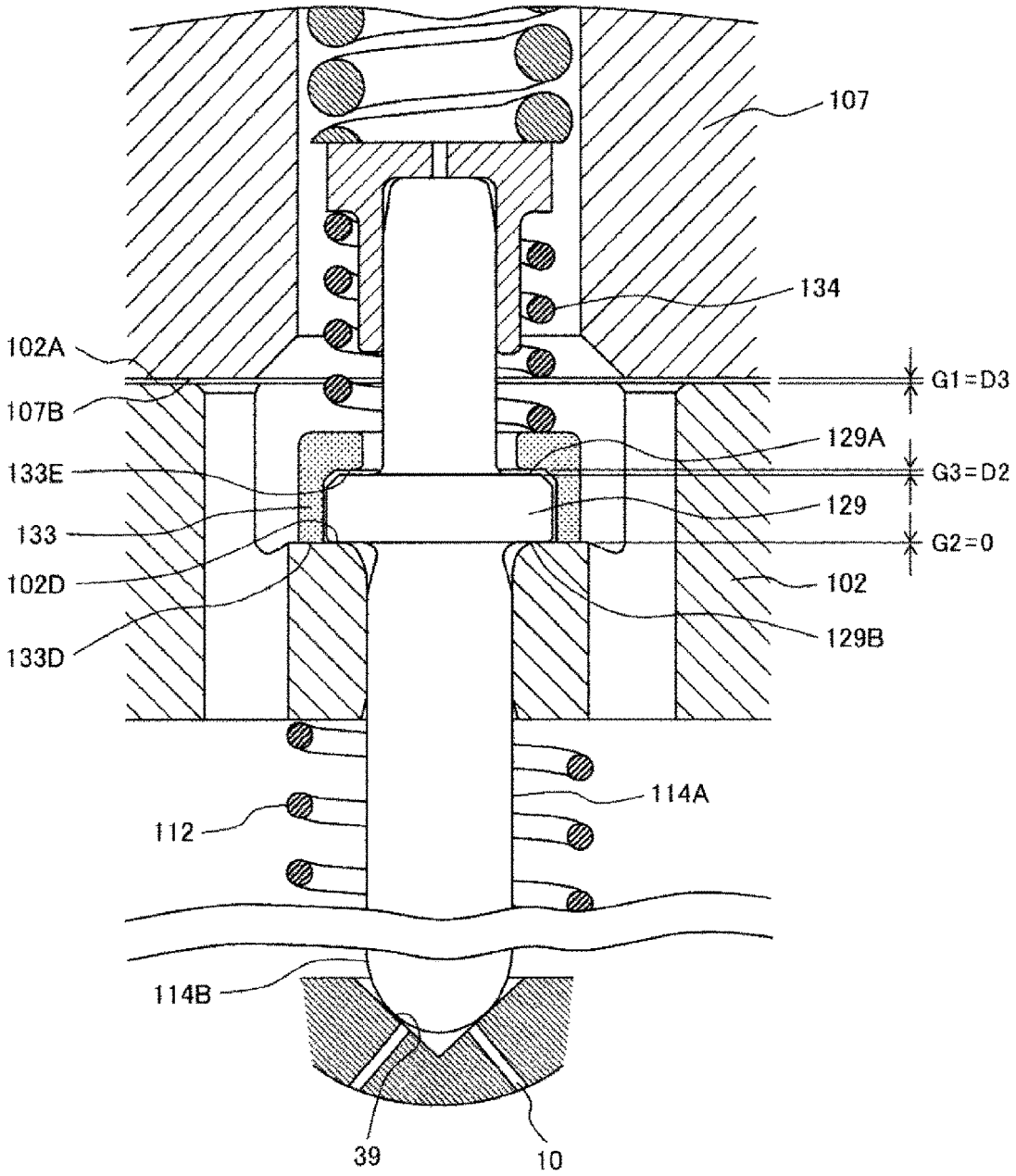
FIG. 11 is a partially enlarged view of FIG. 1 and a cross-sectional view illustrating a state where the anchor 102 pushed back by the second spring 112 collides with a lower end face 129B of a stepped portion of the plunger rod 114A.

FIG. 11 is a partially enlarged view of FIG. 1 and a cross-sectional view illustrating a state where the anchor 102 pushed back by the second spring 112 collides with the lower end face 129B of the stepped portion of the plunger rod 114A. The state illustrated in FIG. 11 is a state at time t6 on the right end of the section VI (t5 to t6) of FIG. 12. That is, the state illustrated in FIG. 10 transitions to the state illustrated in FIG. 11.

In the state illustrated in FIG. 11, the anchor 102 pushed back by the second spring 112 collides with the lower end face 133D of the intermediate member 133, and then, is continuously displaced upward by the inertial force to push the intermediate member 133 upward. The anchor 102 pushing the intermediate member 133 upward receives the biasing force of the third spring 134 via the intermediate member 133 before colliding with the lower end face 129B of the stepped portion of the plunger rod 114A, and upward kinetic energy thereof is attenuated. When the anchor 102 collides with the lower end face 129B of the stepped portion, the plunger rod 114A is displaced in the valve opening direction depending on the impact force thereof, and the valve body 114B is separated from the valve seat 39. The impact force when the anchor 102 collides with the lower end face 129B of the stepped portion is determined depending on the biasing force (set load) of the second spring 112 and the third spring 134. In the present embodiment, the upward displacement of the anchor 102 is stopped before the anchor 102 collides with the lower end face 129B of the stepped portion of the plunger rod 114A by adjusting the biasing force of the second spring 112 and the third spring 134.

Alternatively, it may be configured such that the plunger rod 114A biased by the first spring 110 is not displaced in the valve opening direction even when the anchor 102 collides with the lower end face 129B of the stepped portion of the plunger rod 114A. That is, it may be configured such that it is possible to sufficiently attenuate the kinetic energy of the anchor 102 until the anchor 102 moves by the distance D2 from the position in contact with the lower end face 133D of the intermediate member 133 and collides with the lower end face 129B of the stepped portion of the plunger rod 114A.

In the present embodiment, the kinetic energy of the anchor 102 is gradually attenuated by the biasing force of the third spring 134 while the anchor 102 moves by the gap G2=D2 illustrated in FIG. 10 so that the anchor 102 does not collide with the lower end face 129B of the stepped portion of the plunger rod 114A. Alternatively, the kinetic energy of the anchor 102 is gradually reduced to reduce a momentary impact force received from the anchor 102 colliding with the lower end face 129B of the stepped portion of the plunger rod 114A. Accordingly, the plunger rod 114A biased by the first spring 110 maintains the state illustrated in FIG. 11 and is not displaced even if receiving the impact force caused by the collision of the anchor 102 (time t6 of FIG. 12). The anchor 102 having lost the inertial force receives the biasing force of the third spring 134 via the intermediate member 133 and is pushed back to a position at which the bottom face 133E of the concave portion of the intermediate member 133 abuts on the upper end face 129A of the stepped portion of the plunger rod 114A (a section VII of FIG. 12). As a result, the movable element 114 returns to the state illustrated in FIG. 2 and reaches the valve-closing stop state (sections VII and VIII of FIG. 12).

Here, the section VII of FIG. 12 will be described in detail.

When the anchor 102 released from the engagement with the lower end face 129B of the stepped portion of the plunger rod 114A is pushed back by the second spring 112 and collides with the lower end face 129B of the stepped portion again, there is a possibility that the plunger rod 114A is displaced in the valve opening direction as indicated by reference sign 140 in the section VII between time t6 and t7 of FIG. 12. At this time, the anchor 102 is displaced in the valve closing direction as indicated by reference sign 141.

Whether the plunger rod 114A is displaced in the valve opening direction is greatly affected by the biasing force (set load) of the second spring 112. There is a higher possibility that the plunger rod 114A is displaced in the valve opening direction as the biasing force of the second spring 112 is set to be larger, and further, the displacement amount thereof is also increased. When the plunger rod 114A is displaced in the valve opening direction so that the valve body 114B is separated from the valve seat 39, the fuel is injected. This fuel injection is called secondary injection or the like and causes an error in the fuel injection amount.

On the other hand, when the biasing force of the second spring 112 is decreased in order to avoid the secondary injection, the amount of the downward displacement of the anchor 102 alone is increased, and the time required until reaching the valve-closing stop state is increased. Then, it is difficult to implement the fuel injection at a short time interval, and there is a possibility that it is difficult to implement the fuel injection suitable for combustion of an internal combustion engine.

In the present embodiment, the kinetic energy of the anchor 102 is gradually attenuated using the gap G2=D2 and the biasing force of the third spring 134 so that the anchor 102 does not collide with the lower end face 129B of the stepped portion of the plunger rod 114A. Alternatively, the kinetic energy of the anchor 102 is gradually reduced to reduce a momentary impact force that is received from the anchor 102 at the time of the collision with the lower end face 129B of the stepped portion of the plunger rod 114A. Further, the displacement of the plunger rod 114A indicated by reference sign 140 and the displacement of the anchor 102 indicated by reference sign 141 are prevented.

Characteristics of the present embodiment will be described.

(1) The third spring 134 is arranged so as to suppress displacement of the anchor 102 when the anchor 102 alone is displaced in the valve opening direction.

(2) The intermediate member 133 forms the gap G3=D2 between the engagement portion (the bottom face 102D of the concave portion) of the anchor 102 and the engagement portion (the lower end face 129B of the stepped portion) of the plunger rod 114A, and applies the biasing force in the valve closing direction using the third spring 134 while the anchor 102, which is displaced in the valve opening direction, is displaced by the gap G3=D2.

(3) The cap 132 serving as a support portion of the third spring 134 receives the biasing force generated by the first spring 110, and does not require a strong fixing force. Thus, the welding of the cap 132 is not required.

(4) A fixing portion (the tubular portion 132C) of the plunger rod 114A with respect to the cap 132 is arranged at the inner side of the third spring 134, and thus, the structure becomes compact. In addition, it is possible to enhance the fixing force by securing a length of the fixing portion (the tubular portion 132C) and to secure the sufficient fixing force only by performing the press-fitting.

(5) Since the third spring 134 and the intermediate member 133 are assembled with the plunger rod 114A, it is easy to confirm and adjust each operation of the third spring 134 and the intermediate member 133 before the assembly with the fuel injection valve. The biasing force of the third spring 134 can be changed by relatively displacing the cap 132 in the axial direction of the plunger rod 114A. In this case, the bottom face 132H of the cap 132 does not abut on the end portion 114A-1 of the plunger rod 114A, it is difficult to confine the foreign matters generated at the time of performing the press-fitting to the gap portion 182. In this case, a configuration of a fourth embodiment to be described later may be preferably employed.

(6) Since the third spring 134 and the intermediate member 133 are assembled between the anchor 102 and the upper end portion of the plunger rod 114A from the upper end portion of the plunger rod 114A, the assembly work between the anchor 102 and the plunger rod 114A is simple and easy. (7) In a structure described in PTL 1, a stopper penetrating portion having the same function as the intermediate member 133 of the invention of the present application is interposed between an outer circumferential face of a valve member (plunger rod) and an inner circumferential face of a through-hole of a movable core (anchor), and thus, a sliding face is formed in the stopper penetrating portion on an inner circumferential face side and on an outer circumferential face side, and processing accuracy of the stopper penetrating portion influences on each eccentricity of the anchor and the valve body and influences on each operation of the anchor and the valve body. In the present embodiment, the intermediate member 133 is arranged at the outer side of the sliding face between the plunger rod 114A and the anchor 102, and thus, the intermediate member 133 does not influence each eccentricity of the plunger rod 114A and the anchor 102, and has little influence on each operation of the plunger rod 114A and the anchor 102.

According to the present embodiment, it is possible to remove or reduce the impact force of the anchor 102 that acts on the plunger rod 114A in the valve opening direction using the third spring 134, and thus, it is unnecessary to weaken the biasing force of the second spring 112. Furthermore, a range of the biasing force generated by the third spring 134 acting on the anchor 102 is limited to a short range of the distance D2 from the lower end face 129B of the stepped portion of the plunger rod 114A. That is, the range of the biasing force generated by the third spring 134 acting on the anchor 102 is regulated by a partial range on a side where the bottom face 102D of the concave portion of the anchor 102 and the lower end face 129B of the stepped portion of the plunger rod 114A are engaged with each other, in a range that enables the anchor 102 to be relatively displaced with respect to the plunger rod 114A. Thus, it is possible to reduce the secondary injection, and further, to promptly turn the anchor 102 into the valve-closing stop state. Accordingly, it is possible to provide the fuel injection valve that is capable of injecting the fuel at the short time interval.

Second Embodiment

Figure 13:
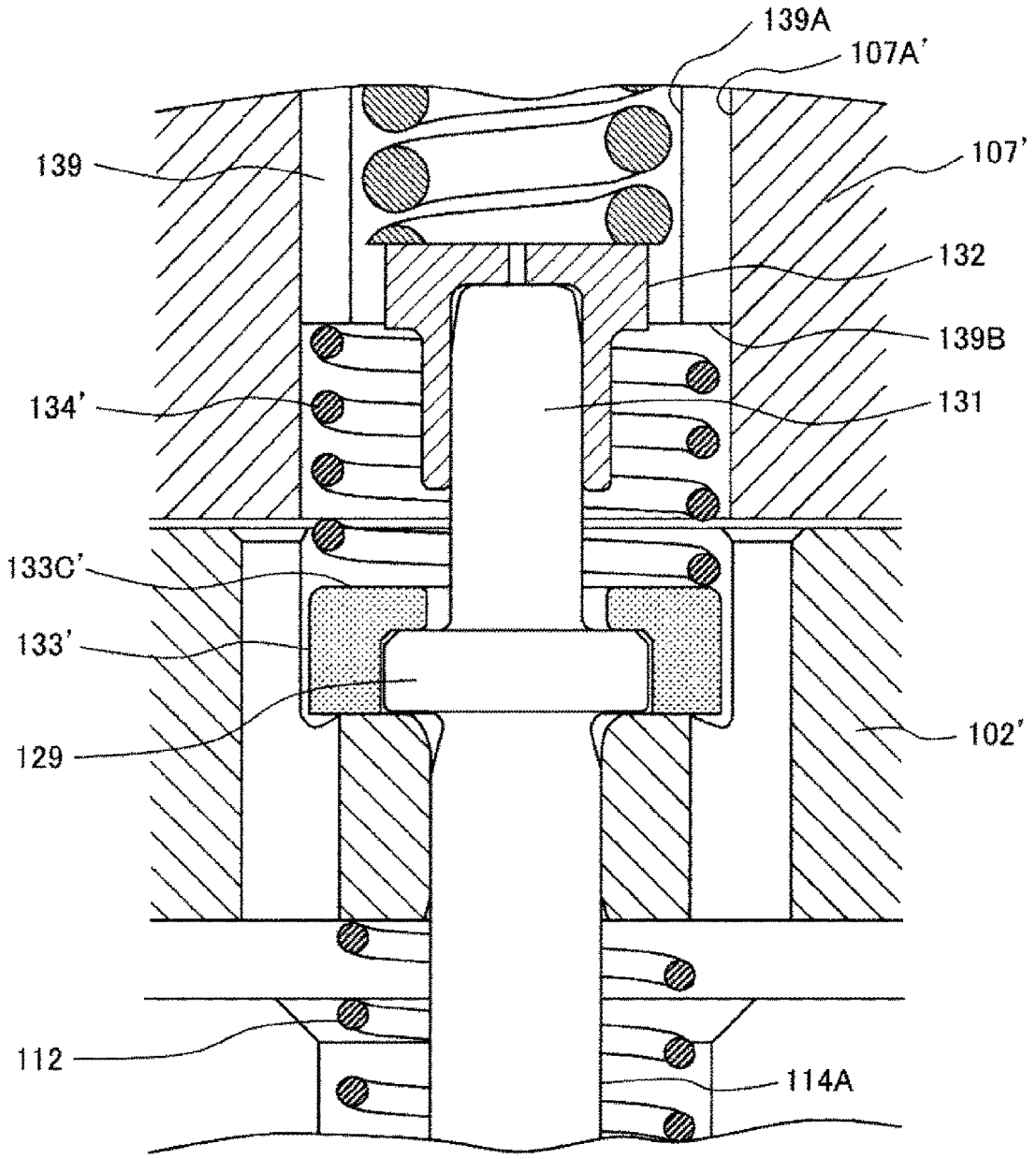
FIG. 13 is a partially enlarged view illustrating the same part as FIG. 2 in a fuel injection valve according to a second embodiment in an enlarged manner.

A second embodiment will be described with reference to FIG. 13. FIG. 13 is a partially enlarged view illustrating the same part as FIG. 2 in a fuel injection valve according to the second embodiment in an enlarged manner.

The present embodiment is different from the first embodiment in terms of the arrangement of a third spring 134'. In the present embodiment, one end portion of the third spring 134' is supported by a tubular spring seat member 139 which is provided in an inner circumferential portion of a fixed core 107'. Accordingly, the one end portion of the third spring 134' is supported by the fuel injection valve on a body side. The other end portion of the third spring 134' abuts on an upper end face 133C' of an intermediate member 133', which is similar to the first embodiment.

The outer diameter of the third spring 134' is set to be larger than the outer diameter of the third spring 134 of the first embodiment in order to support the one end portion of the third spring 134' on the body side of the fuel injection valve. In addition, an outer diameter of the intermediate member 133' is set to be large as the outer diameter of the third spring 134' is set to be large. Further, the tubular spring seat member 139 is fixed to an inner circumferential face (through-hole) 107A' of the fixed core 107', and the one end portion of the third spring 134 is supported by the spring seat member 139. The spring seat member 139 is fixed to the inner circumferential face 107A' of the fixed core 107' by press-fitting.

It is also possible to form the inner circumferential face of the fixed core 107' in a stepped shape. That is, the fixed core 107' may be formed in a shape including the spring seat member 139. However, when the fixed core 107' is formed in the shape including the spring seat member 139, it is difficult to insert the third spring 134' and the intermediate member 133' into a through-hole 139A to be assembled with the fuel injection valve after the assembly of the fixed core 107'.

Thus, the present embodiment provides the structure where the tubular spring seat member 139 is fixed to the inner circumferential face 107A' of the fixed core 107'. After the assembly of the fixed core 107', the third spring 134' and the intermediate member 133' are inserted into the through-hole 107A' of the fixed core 107' to be assembled inside the fuel injection valve, and the spring seat member 139 is fixed to the inner circumferential face 107A' of the fixed core 107' by press-fitting to support the third spring 134'. In this case, the intermediate member 133' maybe assembled with the plunger rod 114A or separated from the plunger rod 114A. However, the assembly work becomes easy when the intermediate member 133' is assembled with the plunger rod 114A.

In the first embodiment, the third spring 134 receives a force of the anchor 102 displaced upward at time t6 of FIG. 12, the force is transmitted to the plunger rod 114A via the cap 132. In the first embodiment, the third spring 134 is used to prevent a large impact force from being momentarily applied to the plunger rod 114A by the collision between the anchor 102 and the plunger rod 114A. However, the plunger rod 114A receives the force acting in the valve opening direction from the anchor 102 via the third spring 134 and the cap 132.

Since the one end portion of the third spring 134' is supported by the tubular spring seat member 139 provided in the inner circumferential portion of the fixed core 107 in the present embodiment, the plunger rod 114A does not receive the force acting in the valve opening direction from the anchor 102.

Configurations other than the above-described ones are the same as those of the first embodiment, and each part of the present embodiment has the same function as that of the first embodiment. In addition, the characteristics (1) to (7) described in the first embodiment except for characteristics (5) and (6) are also applied to the present embodiment. Incidentally, the cap 132 only has the function as a spring seat of the first spring 110 in the present embodiment, and the spring seat of the first spring 110 maybe directly formed in the upper end portion of the plunger rod 114A.

Third Embodiment

Figure 15:
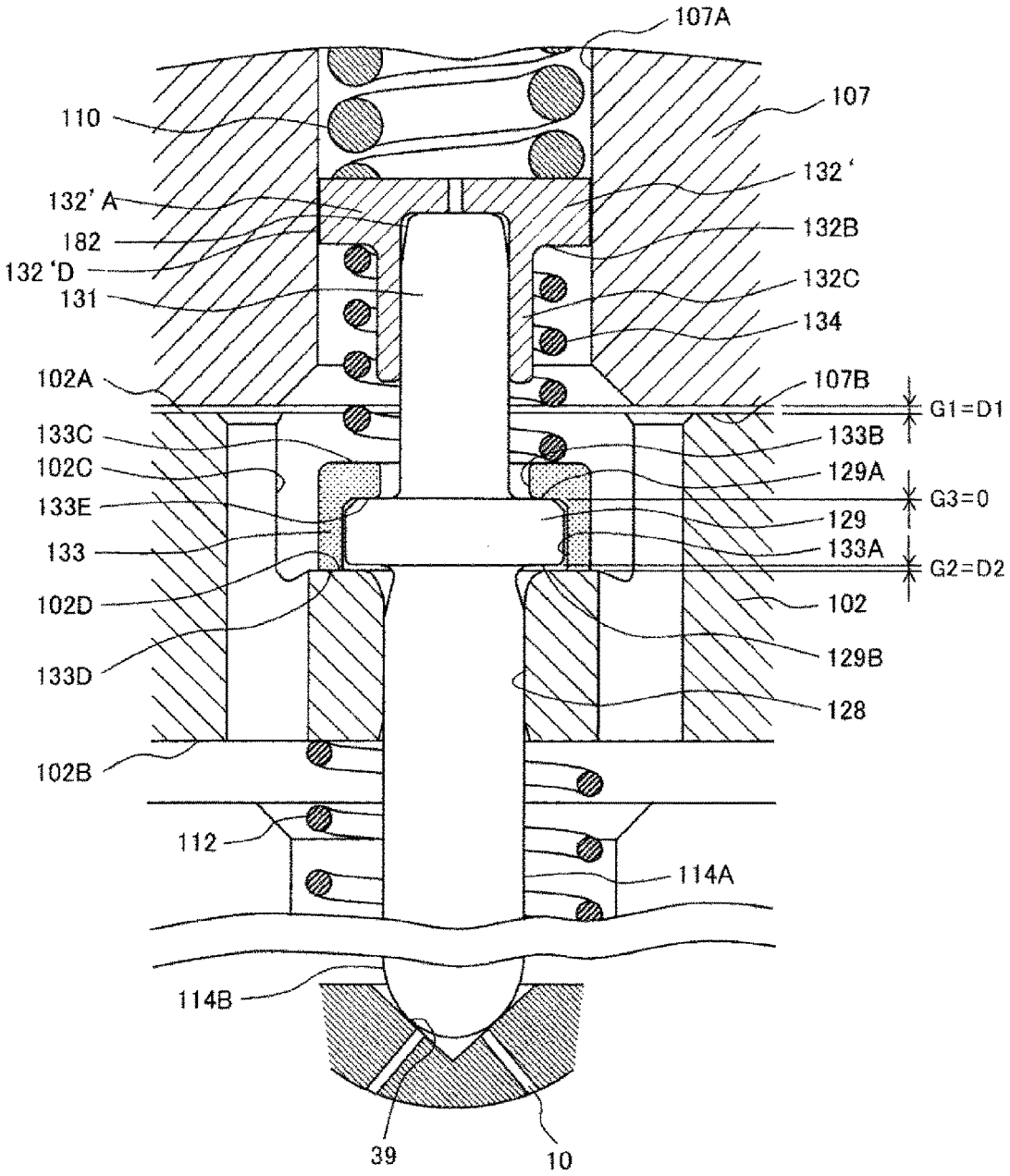
FIG. 15 is a partially enlarged view of FIG. 1 which illustrates details of a fuel injection valve according to a third embodiment.
Figure 16:
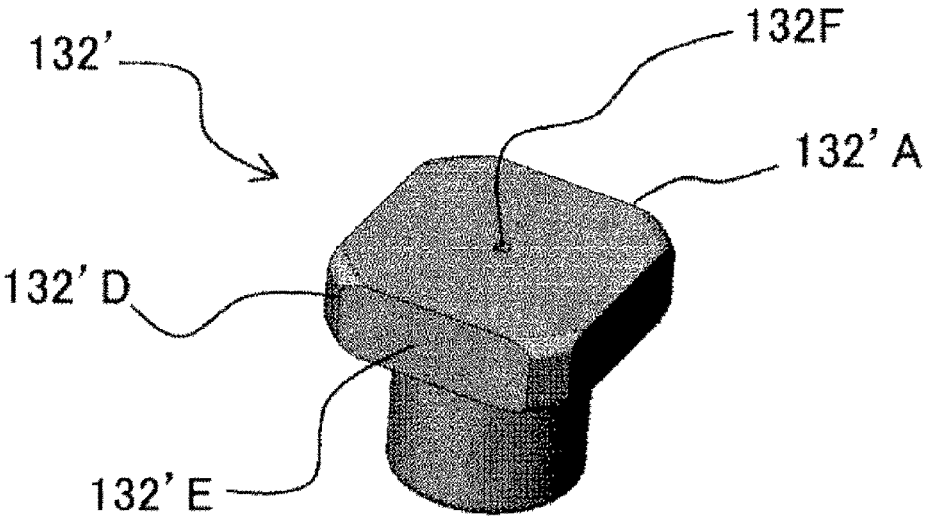
FIG. 16 is a perspective view illustrating the exterior appearance of a cap (spring seat member) 132' according to the third embodiment.

A third embodiment will be described with reference to FIGS. 15 and 16. FIG. 15 is a partially enlarged view of FIG. 1 which illustrates details of a fuel injection valve according to the present embodiment. FIG. 16 is a perspective view illustrating the exterior appearance of a cap (spring seat member) 132'. Hereinafter, a difference from the first embodiment will be described.

In the present embodiment, it is configured such that an outer circumferential face 132'D of the cap 132' abuts on an inner circumferential face of the through-hole 107A of the fixed core 107 and slides with respect to the inner circumferential face of the through-hole 107A at the time of opening or closing the valve.

In the present embodiment, the inner circumferential face of the through-hole 107A becomes a guide face and guides movement of the outer circumferential face 132'D of the cap 132' in the valve opening-and-closing direction. Therefore, an appropriate gap is formed between an outer circumferential face of the anchor 102 and an inner circumferential face of the large-diameter tubular portion 23 of the nozzle holder 101 in the present embodiment although the outer circumferential face of the anchor 102 is in contact with the inner circumferential face of the large-diameter tubular portion 23 of the nozzle holder 101 to guide the movement in the up-and-down direction (valve opening-and-closing direction) in the first embodiment.

As illustrated in FIG. 16, a notched face 132'E is provided in a flange portion 132'A of the cap 132', and the outer circumferential face 132'D abutting on the inner circumferential face of the through-hole 107A of the fixed core 107 is arranged with a gap in the circumferential direction. The notched face 132'E forms a fuel passage portion that communicates upper and lower fuel passages of the flange portion 132'A of the cap 132'. In the present embodiment, the four outer circumferential faces 132'D and the four notched faces 132'E are provided in the circumferential direction of the flange portion 132'A.

Further, the flange portion 132'A and the tubular portion 132C to which the plunger rod 114A is press-fitted are shifted in the axial direction of the plunger rod 114A in the present embodiment, it is possible to suppress a change of an outer diameter of the flange portion 132'A even when a diameter of the tubular portion 132C is increased due to the press-fitting. Accordingly, it is possible to favorably maintain the sliding between the outer circumferential face 132'D of the flange portion 132'A of the cap 132' and the inner circumferential face of the through-hole 107A of the fixed core 107. The tapered portion 182 is provided up to the lower side of the flange portion 132'A in the present embodiment, and accordingly, it is possible to more reliably prevent deformation of the flange portion 132'A caused by the press-fitting.

Configurations other than the above-described ones are the same as those of the first embodiment. In addition, the present embodiment may be applied to the second embodiment.

Fourth Embodiment

Figure 17:
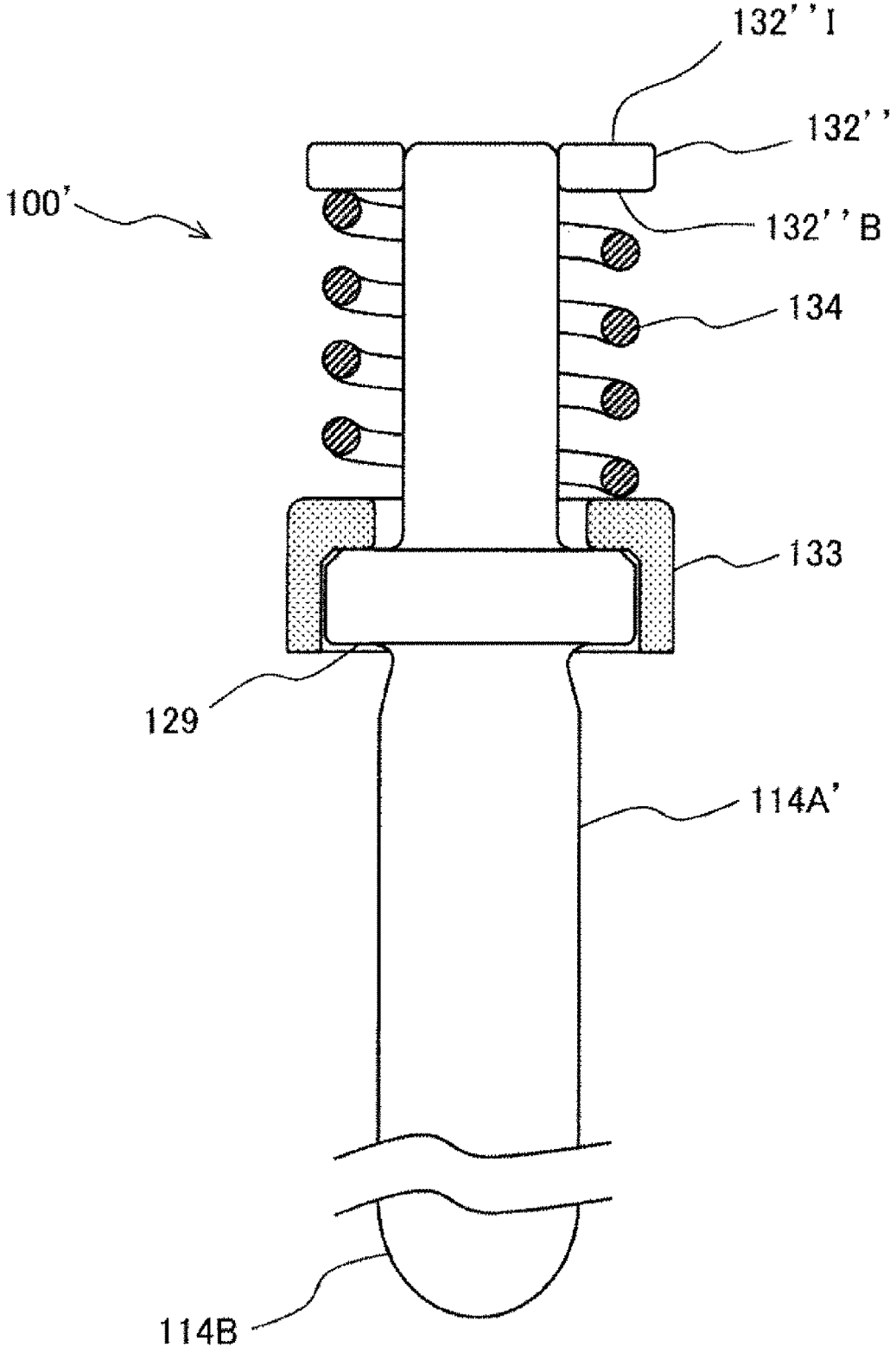
FIG. 17 is an external view illustrating the exterior appearance of a valve member assembly 100' according to a fourth embodiment.

The fourth embodiment will be described with reference to FIG. 17. FIG. 17 is an external view illustrating the exterior appearance of the valve member assembly 100. Hereinafter, a difference from the first embodiment will be described.

A spring seat member 132" according to the present embodiment is configured only using the flange portion 132A of the cap 132 according to the first embodiment. An upper end face 132"I of the spring seat member 132" forms a spring seat of the first spring 110 and a lower end face 132"B of the spring seat member 132" forms a spring seat of the third spring 134.

The spring seat member 132" is fixed to an upper end portion of the plunger rod 114A (that is, an upper end of the protruding portion 131) by press-fitting. The spring seat member 132" is formed using an annular member, and foreign matters generated by press-fitting are removed after press-fitting the spring seat member 132" to the plunger rod 114A'.

In addition, the tapered portion 182 may be provided or not necessarily provided in an upper end portion of the plunger rod 114A' in the present embodiment although the tapered portion 182 is provided in the upper end portion of the plunger rod 114A in the first embodiment. When the tapered portion 182 is provided, the spring seat member 132" is arranged below the tapered portion 182.

In the present embodiment, it is possible to reduce the weight of the movable element 114 as compared to the first embodiment.

Configurations other than the above-described ones are the same as those of the first embodiment. In addition, the present embodiment may be applied to the first to third embodiments. When the present embodiment is applied to the third embodiment, the spring seat member 132" according to the present embodiment may be configured only using the flange portion 132'A of the cap 132' according to the third embodiment.

Fifth Embodiment

Figure 18:
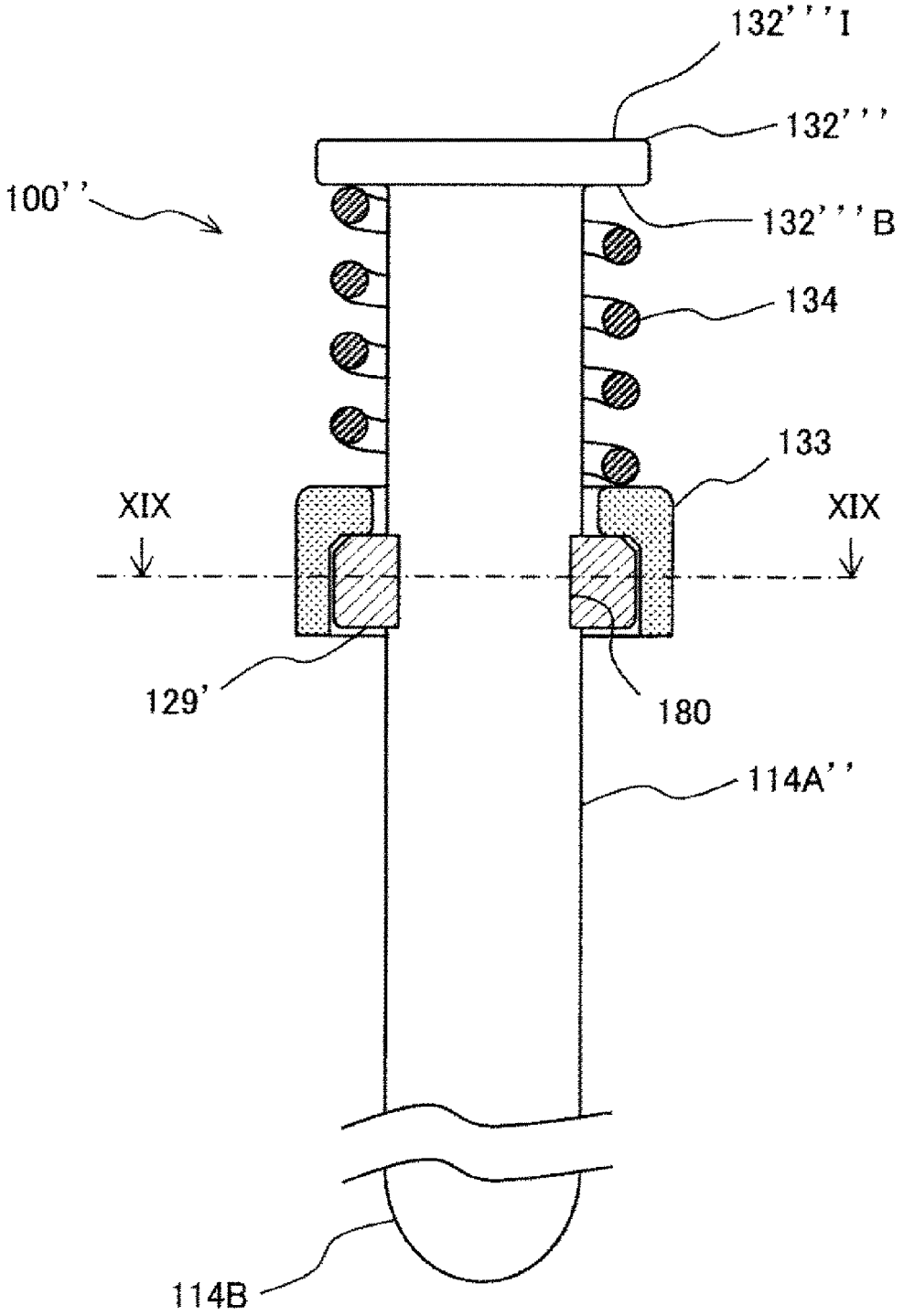
FIG. 18 is an external view illustrating the exterior appearance of a valve member assembly 100" according to a fifth embodiment.
Figure 19:
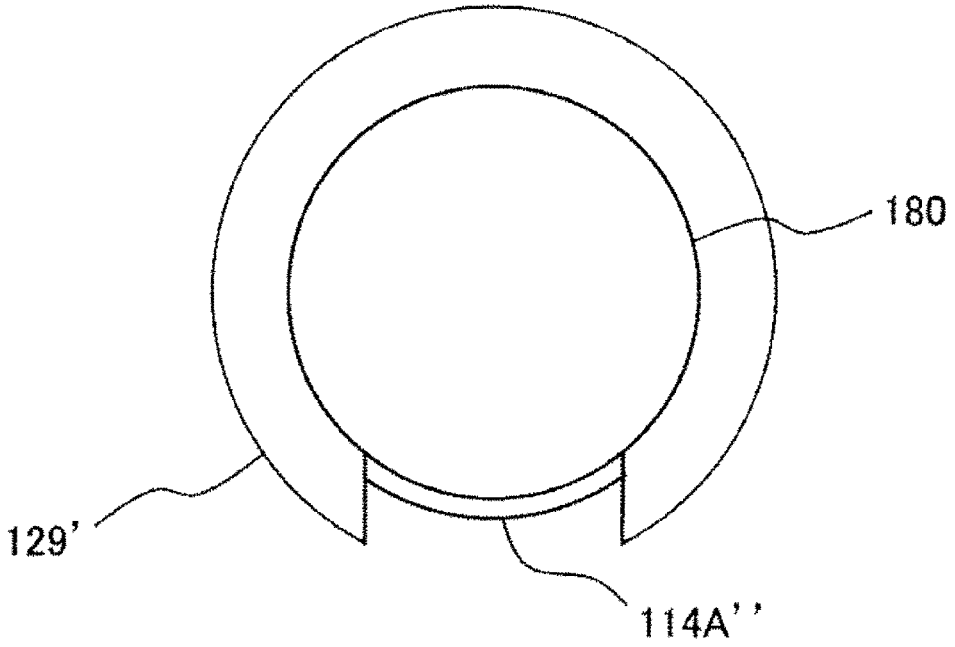
FIG. 19 is a cross-sectional view illustrating only a stepped portion forming member 129' and a plunger rod 114A" in a cross-section taken along a line XIX-XIX of FIG. 18.

A fifth embodiment will be described with reference to FIGS. 18 and 19. FIG. 18 is an external view illustrating the exterior appearance of a valve member assembly 100". FIG. 19 is a cross-sectional view illustrating only a stepped portion forming member 129' and a plunger rod 114A" in a cross-section taken along a line XIX-XIX of FIG. 18. Hereinafter, a difference from the first embodiment will be described.

A spring seat member 132'" according to the present embodiment is configured only using the flange portion 132A of the cap 132 according to the first embodiment, and further, the spring seat member 132'" is formed to be integrated in an upper end portion of the plunger rod 114A". An upper end face 132'"I of the spring seat member 132'" forms a spring seat of the first spring 110 and a lower end face 132'"B of the spring seat member 132'" forms a spring seat of the third spring 134.

In addition, the stepped portion 129 according to the first embodiment is configured using the stepped portion forming member 129' in the present embodiment. That is, the stepped portion forming member 129' is fitted to the plunger rod 114A" to form a stepped portion. Thus, an annular concave portion 180 is formed in an outer circumferential face of the plunger rod 114A", and the stepped portion forming member 129' is fitted to the concave portion 180.

In the present embodiment, the third spring 134 is assembled with the plunger rod 114A" from the valve body 114B side, and thereafter, the intermediate member 133 is assembled therewith. Thereafter, the stepped portion forming member 129' is assembled with the plunger rod 114A" in the state of pushing the intermediate member 133 to the spring seat member 132'" side.

As illustrated in FIG. 19, the stepped portion forming member 129' has a shape in which a part of the annular member is notched (C-shape), and the plunger rod 114A" is inserted into the inner side of the stepped portion forming member 129' from the notched portion to assemble the plunger rod 114A" and the stepped portion forming member 129' with each other. Incidentally, the stepped portion forming member 129' may be fixed to the outer circumferential face of the plunger rod 114A" by press-fitting.

Configurations other than the above-described ones are the same as those of the first embodiment. In addition, the present embodiment may be applied to the first to third embodiments.

Incidentally, the present invention is not limited to the respective embodiments described above, and includes various modifications. For example, the above-described embodiments have been described in detail in order to describe the present invention in an easily understandable manner, and are not necessarily limited to one including the entire configuration thereof. In addition, addition, deletion or substitution of other configurations can be made with respect to some configurations of each embodiment.

REFERENCE SIGNS LIST

39 valve seat
102 anchor
102A upper end face of anchor 102
102D bottom face of concave portion of anchor 102
107 fixed core
107B lower end face of fixed core 107
107' fixed core
107A' inner circumferential face (through-hole) of fixed core 107'
110 first spring
112 second spring
114 movable element
114A plunger rod
114B valve body
129 stepped portion of plunger rod 114A
129A upper end face of stepped portion 129
129B lower end face of stepped portion 129
133 intermediate member
133D lower end face of intermediate member 133
133E bottom face of concave portion of intermediate member 133
133' intermediate member
133C' upper end face of intermediate member
134 third spring
134' third spring
139 tubular spring seat member

The invention claimed is:

1. A fuel injection valve comprising:

a valve member which includes a valve body abutting on a valve seat at a tip end portion;

an anchor which forms a movable element together with the valve member and is configured to be relatively displaceable in a valve opening-and-closing direction with respect to the valve member;

a fixed core which attracts the anchor in a valve opening direction by causing a magnetic attraction force to act on the anchor;

a first spring which biases the valve member in a valve closing direction;

a second spring which biases the anchor in the valve opening direction from an opposite side of the fixed core; and a third spring which biases the anchor in the valve closing direction from the fixed core side and has a biasing force smaller than a biasing force of the first spring and larger than a biasing force of the second spring, wherein engagement portions are provided in both the anchor and the valve member so as to be engaged with each other when the anchor is displaced in the valve opening direction with respect to the valve member, thereby regulating the displacement of the anchor in the valve opening direction.

2. The fuel injection valve according to claim 1, wherein a range of the biasing force, generated by the third spring, acting on the anchor is regulated in a partial range on the engagement portion side in a range that enables the anchor to be relatively displaced with respect to the valve member.

3. The fuel injection valve according to claim 2, comprising a gap forming member which abuts on the anchor in a state of being positioned at a reference position of the valve member to form a gap between the engagement portion on the valve member side and the engagement portion on the anchor side, wherein the gap forming member is biased by the third spring in the valve closing direction to be positioned at the reference position.

4. The fuel injection valve according to claim 3, wherein the valve member includes a rod portion and a stepped portion which protrudes from an outer circumferential face of the rod portion in a flange shape, the engagement portion on the valve member side is formed using a step of the stepped portion on the valve body side, the reference position is provided at a step of the stepped portion on an opposite side to the valve body side, the gap forming member includes a concave portion which is recessed from a lower end face side opposing the anchor toward an upper end face side on the fixed core side, the concave portion is formed to have a depth dimension which is larger than a gap dimension between both the steps of the stepped portion, and when a bottom face of the concave portion abuts on the step forming the reference position, the gap is formed between the lower end face and the step forming the engagement portion.

5. The fuel injection valve according to claim 4, wherein the valve member includes a spring seat member of the third spring at an end portion of the rod portion on an opposite side to the valve body side, and the third spring has one end portion supported by the spring seat member and another end portion supported by the upper end face of the gap forming member, thereby biasing the gap forming member in the valve closing direction.

6. The fuel injection valve according to claim 5, wherein the third spring and the gap forming member are assembled with the valve member in an integrated manner.

7. The fuel injection valve according to claim 6, wherein the spring seat member includes a flange portion in which a spring seat of the third spring is formed, and a spring seat of the first spring is formed on a face of the flange portion on an opposite side to a face on which the spring seat of the third spring is formed.

* * * * *